US010796548B2

(12) United States Patent
Adoni Mohammed et al.

(10) Patent No.: US 10,796,548 B2
(45) Date of Patent: Oct. 6, 2020

(54) MANAGEMENT OF GUARDIANSHIP OF AN ENTITY INCLUDING VIA ELASTIC BOUNDARIES

(71) Applicant: Intel Corporation, Santa Clara, CA (US)

(72) Inventors: Ghouse Adoni Mohammed, Folsom, CA (US); Tamir Damian Munafo, Naale (IL); Haseeb Mohammed Abdul, Folso, CA (US); Katalin Bartfai-Walcott, El Dorado Hills, CA (US); Mohammed Imran Choudhary, Santa Clara, CA (US); Shao-Wen Yang, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/236,222

(22) Filed: Dec. 28, 2018

(65) Prior Publication Data

US 2019/0139388 A1 May 9, 2019

(51) Int. Cl.
*G08B 21/02* (2006.01)

(52) U.S. Cl.
CPC ..... *G08B 21/0205* (2013.01); *G08B 21/0222* (2013.01); *G08B 21/0241* (2013.01); *G08B 21/0261* (2013.01); *G08B 21/0266* (2013.01); *G08B 21/0269* (2013.01); *G08B 21/0277* (2013.01)

(58) Field of Classification Search
None
See application file for complete search history.

(56) References Cited

U.S. PATENT DOCUMENTS 5,748,087 A * 5/1998 Ingargiola ..... A43B 3/0005 340/539.1
6,111,541 A * 8/2000 Karmel ..... G01C 21/30 342/357.4

(Continued)

OTHER PUBLICATIONS

Xiruo Liu et al., "A Security Framework for the Internet of Things in the Future Internet Architecture", Jun. 28, 2017, 28 pages, www.mdpi.com/journal/futureintemet.

(Continued)

*Primary Examiner* — Fekadeselassie Girma
(74) *Attorney, Agent, or Firm* — Schwabe, Williamson & Wyatt, P.C.

(57) ABSTRACT

In embodiments, one or more non-transitory computer-readable storage media comprise a set of instructions, which, when executed on a processor of a server, causes the server to receive sensor data from at least one sensor proximate to an entity, the entity is a human under care of at least one temporary guardian (TG) pursuant to a set of guardianship rules, the guardianship rules including a pre-defined geographic boundary in which the entity is to remain while under the care of the at least one TG. When executed, the instructions further cause the server to extract location metadata of the entity from the sensor data, and based at least in part on the metadata, send notifications to the TG and to a primary guardian (PG) of the entity when the entity is outside of the pre-defined boundary.

28 Claims, 17 Drawing Sheets

(56) References Cited

U.S. PATENT DOCUMENTS 7,187,278 B2 * 3/2007 Biffar ..... G07C 9/28 340/539.13
9,007,202 B1 * 4/2015 Chan ..... G08B 21/0202 340/539.13
9,747,770 B1 * 8/2017 Bartlett ..... G08B 21/0269
9,860,677 B1 1/2018 Agerstam et al.
9,916,485 B1 * 3/2018 Lilly ..... H04W 4/02
9,928,714 B1 * 3/2018 Lovell ..... G08B 21/0247
9,961,884 B1 * 5/2018 Landers ..... H04W 4/029
2001/0041535 A1 * 11/2001 Karmel ..... G01S 5/14 455/12.1
2002/0021231 A1 * 2/2002 Schlager ..... G08B 21/0269 340/984
2002/0124295 A1 * 9/2002 Fenwick ..... A61B 5/02055 2/69
2004/0044493 A1 * 3/2004 Coulthard ..... G06Q 10/10 702/122
2005/0280546 A1 * 12/2005 Ganley ..... G08B 13/1427 340/573.4
2006/0083406 A1 * 4/2006 Ishimura ..... G01S 13/84 382/106
2010/0134288 A1 * 6/2010 Huang ..... G08B 21/22 340/572.1
2010/0267361 A1 * 10/2010 Sullivan ..... G08B 25/016 455/404.2
2011/0187537 A1 * 8/2011 Touchton ..... A01K 29/005 340/573.3
2012/0050048 A1 * 3/2012 Sandra ..... G08B 21/0269 340/573.4
2012/0298119 A1 * 11/2012 Reese ..... F41H 13/0018 128/875
2013/0099920 A1 * 4/2013 Song ..... G08B 21/0277 340/539.13
2013/0217332 A1 * 8/2013 Altman ..... H04W 12/04 455/41.2
2014/0323079 A1 * 10/2014 Paolini ..... H04W 4/90 455/404.2
2015/0109126 A1 * 4/2015 Crawford ..... G08B 21/0269 340/539.13
2015/0319568 A1 * 11/2015 Haro ..... H04W 4/029 455/456.1
2015/0339906 A1 * 11/2015 Lee ..... H04N 7/183 348/143
2015/0356861 A1 * 12/2015 Daoura ..... G08B 21/0277 340/539.13
2016/0078742 A1 * 3/2016 Fernandez ..... G08B 21/0261 340/686.6
2016/0080107 A1 * 3/2016 Girouard ..... A61B 5/7275 600/546
2016/0107646 A1 * 4/2016 Kolisetty ..... B60W 50/16 701/96
2016/0205097 A1 7/2016 Yacoub et al.
2016/0304028 A1 * 10/2016 Hathaway ..... G08G 1/04
2017/0084150 A1 * 3/2017 Keyton ..... H04L 67/10
2017/0093952 A1 * 3/2017 Kumar ..... H04L 67/22
2017/0162013 A1 * 6/2017 Jao ..... G08B 13/1427
2017/0257372 A1 9/2017 Meriac
2017/0272415 A1 9/2017 Zhao et al.
2017/0294094 A1 * 10/2017 Watkins ..... G01S 7/003
2017/0352250 A1 * 12/2017 de Barros Chapiewski ..... G08B 25/08
2017/0365147 A1 * 12/2017 Pence ..... G08B 21/0261
2018/0167796 A1 * 6/2018 Raje ..... H04W 4/40
2018/0314251 A1 * 11/2018 Kamalakantha ..... G05D 1/0094
2018/0322758 A1 * 11/2018 Rubinstein ..... G08B 21/24
2018/0348718 A1 * 12/2018 Richardson ..... G08B 21/22
2018/0357876 A1 * 12/2018 Smoak ..... G08B 21/0283
2018/0357887 A1 * 12/2018 Geyer ..... G08B 25/016
2018/0361887 A1 * 12/2018 Labelle ..... G08B 21/22
2019/0043259 A1 * 2/2019 Wang ..... H04N 13/25
2019/0066478 A1 * 2/2019 Reich ..... G08B 21/0211
2019/0073887 A1 * 3/2019 Nagata ..... G08B 21/0277
2019/0103012 A1 * 4/2019 Daoura ..... G08B 21/0294
2019/0133084 A1 * 5/2019 Landers ..... A01K 11/008
2019/0139388 A1 * 5/2019 Adoni Mohammed ..... G08B 21/0222
2019/0156643 A1 * 5/2019 Quilter ..... G08B 21/0288
2019/0214153 A1 * 7/2019 Avitan ..... G16H 80/00
2019/0277972 A1 * 9/2019 Carter ..... G01S 19/14
2019/0375409 A1 * 12/2019 Hunt ..... B60W 50/0098

OTHER PUBLICATIONS

Jennifer G., "Smashing the IoT Deployment Hurdle: Introducing the Intel® Secure Device Onboard Service", Oct. 2, 2017, 8 pages, https://software.intel.com/en-us/blogs/2017/10/03/smashing-iot-deployment-hurdle-with-intel-sdo.

Dongyoung Koo et al., "Privacy-preserving deduplication of encrypted data with dynamic ownership management in fog computing", Jan. 2018, 4 pages, https://www.sciencedirect.com/science/article/pii/S0167739X17301309.

* cited by examiner

MANAGEMENT OF GUARDIANSHIP OF AN ENTITY INCLUDING VIA ELASTIC BOUNDARIES

FIELD

The present invention relates to the technical field of computing, and, in particular, to computer readable media, apparatus, methods and systems, related to management of guardianship of an entity including via elastic boundaries.

BACKGROUND

When a primary guardian of an entity, such as, for example, a parent of a school age child, temporarily transfers guardianship of the entity to another guardian, such as, for example, a teacher at the child's school, a bus driver, a nanny, or the like, the primary guardian does not retain any enforceable control over the entity during the temporary guardianship. Thus, once the entity is no longer in the guardian's care, any rules, regulations, wishes, policies, or the like, according to which the primary guardian manages the guardianship of the entity, are not transferred, accepted or enforced. Thus, for example, a parent lacks the ability to define or describe his or her guardianship attributes to the entity or property, such as by creating a policy that may dictate, for example: "my child cannot leave the school." Moreover, the parent lacks the ability to know if such a policy is violated, or enforce it, even if they do know. Similarly, the parent lacks the ability to define capabilities of alternative guardians so as to ensure that terms and conditions are defined for their service, such as, for example, when a regular teacher of the child enlists other teachers, heretofore unknown to the child, to assist in an activity or a field trip.

DETAILED DESCRIPTION

Figure 1:
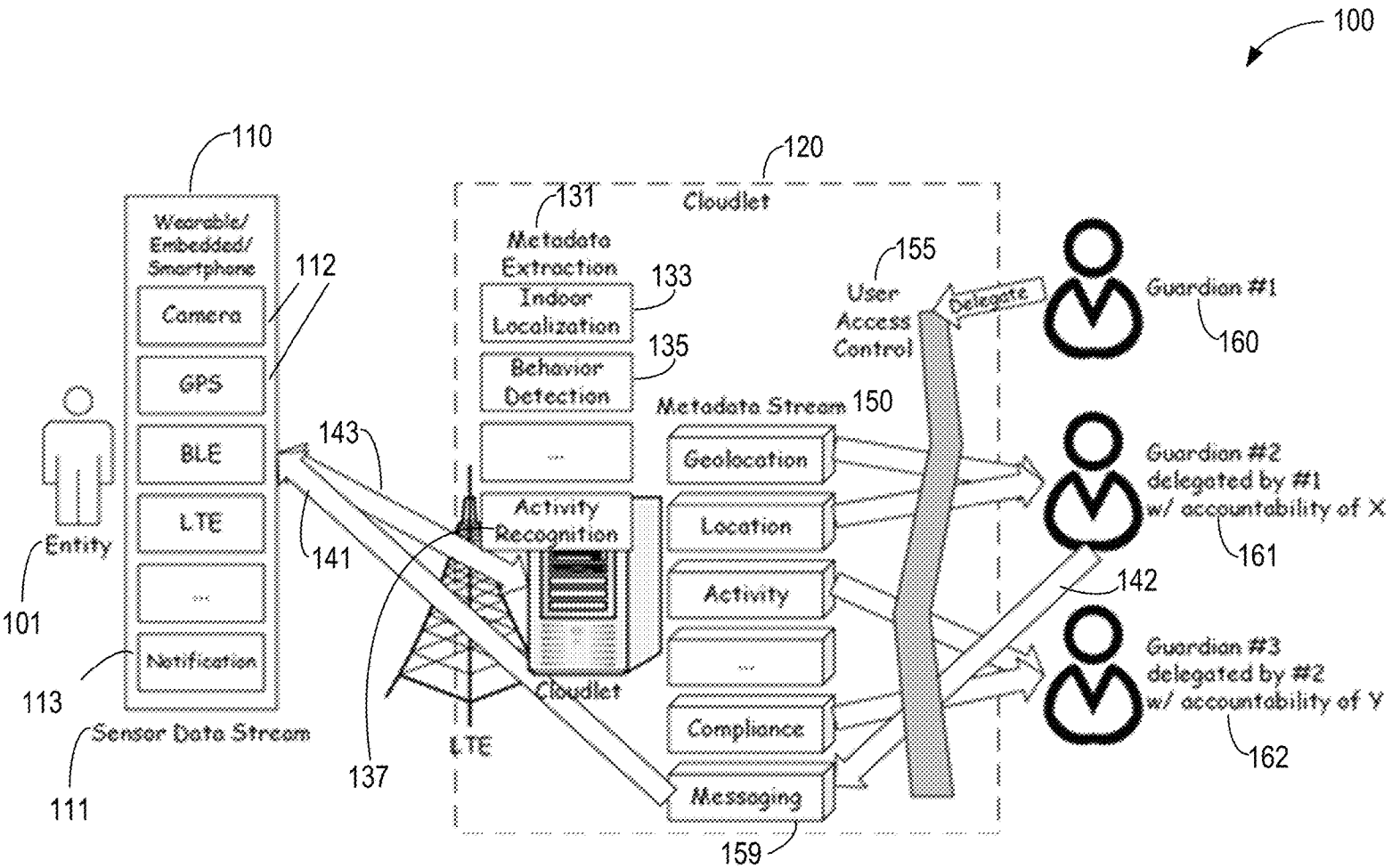
FIG. 1 illustrates an example system incorporated with the guardianship management technology of the present disclosure, in accordance with various embodiments.

In embodiments, one or more non-transitory computer-readable storage media comprise a set of instructions, which, when executed on a processor of a server, causes the server to receive sensor data from at least one sensor proximate to an entity, the entity is a human under care of at least one temporary guardian (TG) pursuant to a set of guardianship rules, the guardianship rules including a pre-defined geographic boundary in which the entity is to remain while under the care of the at least one TG. When executed, the instructions further cause the server to extract location metadata of the entity from the sensor data, and based at least in part on the metadata, send notifications to the TG and to a primary guardian (PG) of the entity when the entity is outside of the pre-defined boundary.

In embodiments, one or more non-transitory computer-readable storage media comprising a set of instructions, which, when executed on a processor of a cloudlet, cause the cloudlet to receive a guardianship policy for an entity from a PG of the entity, the policy defining one or more transfers of guardianship for the entity between a transferring guardian and a receiving guardian at a pre-defined transfer time, wherein after the transfer the receiving guardian acts as guardian of the entity for a pre-defined time period; track the locations of the entity, the transferring guardian and the receiving guardian; and at the pre-defined transfer time: pair a client device of the receiving guardian with an entity device, wherein the entity device is worn by or is proximate to the entity; and provide a communication link between the transferring guardian and the receiving guardian.

In embodiments, an apparatus includes an input interface to receive a sensor data stream from a set of sensors proximate to an entity, wherein the entity is under care of at least one TG pursuant to a policy. In embodiments, the policy rules include pre-defined restrictions on at least one of interactions between the entity and other entities under care of the TG or another TG, or activities the entity may engage in or foods the entity may eat while under the care of the TG. The apparatus further includes an output interface, and an analyzer, coupled to the input interface and to the output interface, to extract metadata from the sensor data stream, the metadata including behavior detection and activity recognition of the entity, and, based at least in part on the metadata, send notifications, via the output interface, to the TG and to a PG of the entity when the pre-defined restrictions are violated.

In embodiments, a method includes receiving a policy regarding care of an entity, receiving a directive of delegation of guardianship from a PG of the entity to a TG of the entity, the directive indicating that the TG is to care for the entity during a pre-defined time, and configuring terms of the guardianship by the TG based on the policy. In embodiments, the method further includes communicating the terms of the guardianship to the TG, tracking the entity and the TG during the pre-defined time, in which, at least in part, the entity is mobile, and virtually tying the entity to the TG during the pre-defined time to control the location of the entity.

In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings which form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), (A) or (B), or (A and B). For the purposes of the present disclosure, the phrase "A, B, and/or C" means (A), (B), (C), (A and B), (A and C), (B and C), or (A, B and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or elements are in direct contact.

As used herein, the term "circuitry" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

As used herein, including in the claims, the term "chip" may refer to a physical integrated circuit (IC) on a computer. A chip in the context of this document may thus refer to an execution unit that can be single-core or multi-core technology.

As used herein, including in the claims, the term "processor" may refer to a logical execution unit on a physical chip. A multi-core chip may have several cores. As used herein the term "core" may refer to a logical execution unit containing an L1 (lowest level) cache and functional units. Cores are understood as being able to independently execute programs or threads.

As used herein, including in the claims, the term "ownership" of an entity by a guardian, or "supervision" of an entity by a guardian, whether a PG or a TG, or an "alternate guardian", refers to a time period in which the guardian is responsible for the entity. Thus, a "transfer of ownership" refers to transfer of primary responsibility for the entity from one guardian to another.

In embodiments, systems and techniques to create a managed relationship between two guardians for the purpose of managing an entity, such as, for example, a child or a thing, are implemented. In embodiments, processes by which a primary guardian defines its sphere of influence over, rules and regulations regarding, as well as wishes for, a managed entity are implemented. Additionally, in embodiments, processes by which these rules and regulations, laws, policies and wishes are temporarily transferred to one or more alternate guardians over pre-defined time periods are also provided.

Example entities that may be the subject of a guardianship according to various embodiments include children, patients in hospitals, aged persons in retirement or nursing homes, or intangibles, such as an automobile that is leased or rented to customers, books lent by a library, or, for example, complex tools rented by a tool rental service. In each case the primary guardian, or owner, seeks to exercise control over any temporary guardianship by, for example, promulgating policies and monitoring the temporary guardianships for compliance with those policies.

Conventionally, when a property or entity is no longer in a PG's care, rules, regulations, wishes or laws that may have been implemented regarding the entity by the PG are not transferred, accepted or enforced. Thus, for example, a parent lacks the ability to define capabilities of an alternative guardian of his or her child to ensure that any conditions of the alternative guardianship desired by the parent are clearly defined, such as "my child's school is to be geo-fenced." Or, for example, the parent lacks the ability to define who an alternative guardian of the entity or property may be, such as, for example, by mandating that while teacher A is allowed to meet the child, teacher B is not. Similarly, the parent lacks the ability to transfer guardianship terms which they have defined to an alternative authorized guardian, such as, for example, by mandating that teacher A cannot take their child out of school, or directing that when teacher A leaves school and a substitute teacher takes over the class, the substitute teacher is not allowed to take their child out of school. Or, for example, parents lack the ability to set a policy of which other parents of their child's class may be trusted to pick them up for events, such as "my son's best friend invited my son to a sleepover after school; the school is authorized to release my son to Mrs. Alta."

Similarly, a PG currently lacks the ability to define a process for maintaining a chain of custody, or assigning terms and conditions of a guardianship. The PG also lacks the ability to manage, or review after the fact, such a process with an alternative guardian, using history, time, location and other metadata, such as, for example, a case where one teacher did not take a child out of school, but another teacher took the child to the zoo on a prior day as planned.

Or, for example, other than informing someone at school in an informal way, a parent lacks an ability to define how to exclude or prohibit an alternative guardian's interaction with an entity, such as by specifying that a certain substitute teacher is not allowed to meet their child. Additionally, a parent currently lacks an ability or process to manage a notification of a violation of guardianship rules, and, in case such a violation occurs, to have the guardian as well as other temporary guardians alerted, For example, by messaging all of the guardians at a school that "teacher A is leaving, without anyone taking over responsibility; my child is thus about to be unattended." Conventionally, a parent also lacks any ability to define a process for emergency management of their child, or how to modify or override terms and conditions imposed upon a temporary guardian, such as, for example, when a child's school is under lockdown and an emergency fire drill is occurring, so that all school children have to leave school.

Thus, although using appropriate technology, a PG guardian may currently track an entity's location, such as, for example, by tracking a child via the child's smartphone, they cannot dynamically assign a TG for the child, or promulgate terms and conditions for the temporary guardianship, whether ad hoc or as a standing policy, for either a particular guardian "Mrs. West, homeroom teacher" or, for example, for a genus, such as "rules for all coaches of after-school athletics programs in which my child is enrolled." This may result in situations where a child cannot be properly supervised in a school simply because the school does not have the same, or similar, rights or authority over the child as does the parent or other PG.

For example, when a parent drops off their child at school, there are various mechanisms (e.g., GPS, WiFi, Bluetooth or SIM/Network) by which the parent may track the child's location. However, there is no current mechanism by which the parent can assign specific directives to the school, in particular, to a TG at the school who is responsible for the child, and then monitor compliance of those directives by the school or the TG. For example, a parent may wish to specify a maximum distance that a child may be from the school premises, and/or from a teacher during a school trip. The parent may further want to know when that distance limit is exceeded, and for how long. Or, for example, the parent may want to assign physical limits regarding their child, and may also want to assign, as may be appropriate, a teacher, bus driver, or nanny to handle relevant tasks, and be accountable to either the parent or a supervisory guardian (e.g., a principal) at all times.

It is true that existing geo-fencing solutions may be used to send alerts to a parent when their child moves outside of a designated area. However, such solutions do not address scenarios in which the designated area is dynamic, such as, for example, a child taking biking lessons, or attending school or after-school outings, etc., where they are on the move, and their "proper place" is constantly changing.

FIG. 1 illustrates an example end-to-end system for management of guardianship of an entity 101, in accordance with various embodiments. The system of FIG. 1 may be used by a guardianship management service, for example. Entity 101, for example a child, is provided with, or wears, an entity device 110. Entity device 110 includes a collection of sensors 112 that produce sensor data stream 111. In embodiments, entity device 110 may be worn by entity 101, for example, or may be a device or smartphone used by the entity. Sensors 112 may include, for example, as shown in FIG. 1, a camera and a global positioning system (GPS). Entity device 110 also includes communications interfaces, such as Long Term Evolution (LTE) and Bluetooth Low Energy (BLE) communications interfaces. In embodiments, entity device 110 is provided with one or more communications channels to transfer data streams from sensors 112 securely to a nearby cloudlet 120. In embodiments, the communication protocols can include 3G, 4G, long term evolution (LTE) and Dedicated short-range communications (DSRC). Notification 113 allows for real-time communication with one or more guardians, such as, for example, Guardian #1 160, Guardian #2 161, and Guardian #3 163.

In embodiments, cloudlet 120 is a server with cloud-like capability. Cloudlets are generally deployed so as to be geographically densely distributed, in a similar fashion as are cell towers, thereby allowing various entities to communicate with the cloudlets. In embodiments, cloudlet 120 provides three capabilities, including metadata extraction, metadata stream generation and communication, and user access control.

In embodiments, cloudlet server 120 communicates both with entity 101 and with one or more guardians, such as, for example, Guardian #1 160, Guardian #2 161, and Guardian #3 163. As shown by communications channel 143 provided between entity device 110 and cloudlet server 120, in embodiments, sensor data stream 111 is received by cloudlet server 120. In particular, in embodiments, a metadata extraction module 131 of cloudlet server 120 receives sensor data stream 111 from an entity device, and processes it. To accomplish this, in embodiments, metadata extraction module 131 includes an indoor localization module 133, a behavior detection module 135, and an activity recognition module 137. Using these, and other possible modules (shown as unlabeled boxes in FIG. 1), metadata extraction module 131 is able to determine where entity 101 is, what he or she is doing, and who is in his or her proximity, at all times that sensor data stream 111 is received by cloudlet 120. In embodiments, this data is used to track entity 101, automatically manage handoffs of the care of entity 101 between one guardian and another guardian, and monitor the guardianship of each guardian to determine the relative proximity of the entity, how long the entity has been under the care of the guardian, whether a policy has been violated, or if another event requiring intervention has occurred. In embodiments, the details of entity 101 as determined by cloudlet 120 are included in a set of outputs that are sent to one or more guardians. This output data is referred to as metadata stream 150, next described.

In embodiments, metadata extraction module 131 generates a metadata stream 150 that, as shown, is communicated to one or more of guardians 160, 161, 163. Metadata stream 150 includes metadata regarding entity 101's geolocation, in terms of objective co-ordinates, as well as entity 101's location, for example, in terms of recognized buildings or known landmarks, e.g., "school" "home" "grandma's house", etc. Metadata stream 150 also includes activity data, describing what entity 101 is then doing, as well as compliance data, which includes notifications when a violation or lack of compliance with a policy occurs, as described in detail below. In embodiments, metadata stream 150 may robustly provide metadata to one or more guardians in a client-server or publisher-subscriber model. In embodiments, this may be implemented with one or more of WebSocket™, Message Queuing Telemetry Transport (MQTT), Data Distribution Service (DDS) or Kafka™, for example.

Continuing with reference to FIG. 1, cloudlet 120 also includes messaging module 159, which receives communications from various guardians, such as Guardian #1 161, Guardian #2 162, and Guardian #3 163, for example, as shown, via communications channel 142. Messaging module 159 also communicates with entity device 110 via communications channel 141, as shown. In embodiments, messaging module also forwards communications from a guardian to an entity across communications paths 142 and 141, and, in some embodiments, also monitors the content of those communications. For example, in embodiments, monitoring of communications between a TG, e.g., Guardian #2 161, and an entity 101, is performed to extract additional metadata about the guardianship, and if an issue arises, as may be defined by a governing policy, it is reported to the PG, e.g., Guardian #1 160.

In embodiments, as noted above, polices are used to intelligently configure guardianships, and to set rules and parameters to automatically keep track of a TG and a moving entity during the duration of a temporary guardianship. In embodiments, given continual or periodic monitoring of entity 101 by cloudlet 120, and also ongoing monitoring of communications from guardians to entities via messaging module 159 of cloudlet 120, an entity is virtually tied to the TG, and an elastic boundary created, as per a promulgated policy that alerts the PG and the TG in case of any disruption. Thus, in embodiments, school children, newborn babies in hospital wards, elderly patients in hospitals or nursing homes, automobiles rented by customers, books or other media borrowed from libraries, and the like, are constantly tracked and alerts sent when the entity moves from the predefined boundaries set by a relevant policy.

Moreover, if an emergency situation is identified regarding the entity, such as, for example, the entity is in an accident, fire, falls off of a boat, or is the victim of a crime, as may be identified by cloudlet 120 of FIG. 1 based on sensor data stream 111, emergency response authorities may also be informed, so that a quick response to an incident may save lives or avoid injury, noting that the alert also provides accurate current location information regarding the entity. Additionally, in such embodiments, the PG may be kept informed the entire time of the emergency, as to the condition of the entity, as to activities of emergency response personnel on scene, and as to which hospital the entity may have been transported to, so that the PG may go and attend to the entity. Also, via communications pathways 142 and 141, a TG or the PG, or a first responder or other authority (via a communications path from coudlet 120 to that first responder or authority, (not shown)), may communicate with entity 101 who may be in a dangerous or emergent situation, both to calm the entity, as well as to keep the TG or PG fully informed.

In embodiments, transfer of an entity's guardianship or ownership, for a period of time, is managed in accordance with rules and policies that govern the relationship. Further, in embodiments, constraints and peripheral information from the entity's environment are taken into consideration by establishing communications between a PG and a TG, or, for example, between two TGs. This is next described, with reference to user access control (UAC) module 155.

In embodiments, cloudlet server 120 also includes a UAC 155 module. UAC makes possible management of metadata communications with various guardians, who, according to a policy promulgated by a PG, may each have different accountabilities. Thus, in embodiments, a guardian's access to metadata streams may be limited by their accountability. For example, as shown in FIG. 1, Guardian #1 160 may be a PG, who delegates guardianship of the entity, a child, to Guardian #2 161, for example, a teacher, at a school. Or, alternatively, Guardian #1 160 may be an owner of a rental car service, who delegates guardianship of the entity, an automobile, to Guardian #2 161, for example, a renter. The delegation is for a limited duration of time, and the delegation occurs at an airport counter maintained by the PG, Guardian #1 160.

In each of the above examples, according to the terms of the delegation of guardianship, Guardian #2 has accountability of X. This may include geographical constraints on the entity, time constraints on the guardianship, actions to take in the event of emergency or other unexpected events, etc. In embodiments, at the time of delegation of guardianship by PG 160, PG may also provide a policy, or, if already previously provided, Guardian #1 may update the terms of that policy, so that cloudlet 120 can process compliance with the policy by any TG of the entity (e.g., Guardian #1 161 and Guardian #2 162), and may send notifications, as appropriate, in the event the relevant policy is violated during the guardianship tenure of either TG of the entity.

Continuing with reference to FIG. 1, subsequent to the delegation to Guardian #2 161, Guardian #2 161, a first TG, then re-delegates guardianship of the entity to Guardian #3 162, a second TG. Pursuant to the terms of the policy then in effect governing guardianships of the relevant entity, Guardian #3 162, the second TG, has accountability of Y. For example, Guardian #2 161 may be a teacher, and Guardian #3 162 a bus driver to take the entity home from school. Or, alternatively, Guardian #2 161 may be a renter of an automobile, as above, and Guardian #3 162 a family member of the renter, but not listed on the actual automobile rental agreement.

In each case, UAC of cloudlet 120 is used by a guardian to delegate guardianship of an entity to a different guardian. Following the delegation, based on the accountabilities of each guardian, in embodiments, metadata stream 150 is appropriately filtered, and a subset of the available metadata in metadata stream 150 is provided to both the transferring and the receiving guardians, as determined by the policy in place for the relevant entity, and the accountability of each TG pursuant to the policy.

Figure 2:
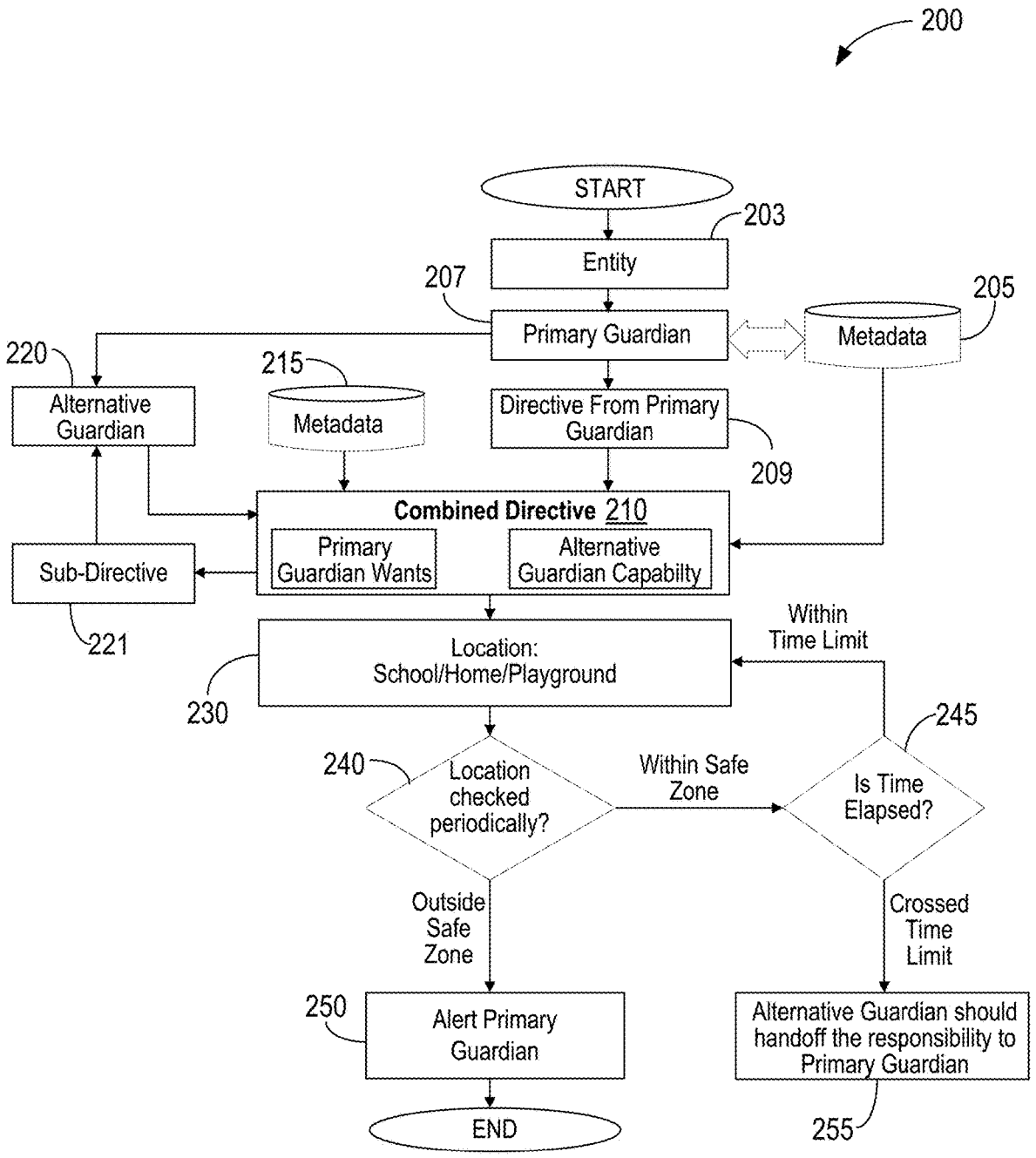
FIG. 2 is an example high level process flow diagram for management of a guardianship of an entity by an alternative guardian, in accordance with various embodiments.

FIG. 2 is an example high level process flow diagram for a process 200 for management of a guardianship by an alternative guardian, in accordance with various embodiments. In such embodiments, for example, a parent may set a directive provides a school that their child attends with physical limits and constraints on the location of the child at all times, and also assign, as appropriate, a teacher, bus driver and nanny to handle relevant child care tasks. In embodiments, although the relationship between a PG and a TG may be temporal, it is well defined and concrete for the time interval during which the child is in the custody of the TG. Therefore, data that is associated with the child by the PG's directive is temporarily accessible to the assigned temporary, or alternative, guardian. In addition, in embodiments, the PG also has access to the child's data during the temporary guardianship, and the parent or primary guardian has access to the child's data from the temporary guardian's perimeter. In embodiments, exchange of data between child, primary guardian and temporary guardian is specified by a directive or policy of the primary guardian.

Process 200 may, for example, be performed by cloudlet 120 shown in FIG. 1, and described above. Process 200 may, in embodiments, have more or less blocks than are shown. With reference to FIG. 2, the example process begins with entity 203, who is under the care of a primary guardian 207, such as, for example, her mother. As a result of the guardianship, primary guardian 207 has access to all metadata 205 extracted from the child's sensor data stream, the latter as shown in FIG. 1, and described above. To implement its wishes, primary guardian 207 issues, at block 209, a directive to cover the manner in which the child is to be cared for. At block 210, the directive from block 209 is combined with metadata 205 and 215, and input of a designated alternative guardian 220, to generate a combined directive regarding the child, at specific locations, shown in block 230.

In embodiments, the combined directive articulates as a policy wants or desires of primary guardian 207, as well as capabilities of alternative guardian 220 during a temporal guardianship of entity 203 by alternative guardian 220. In embodiments, the combined directive also generates one or more sub-directives 221 directed to alternate guardian 220. In embodiments, the combined directive may specify a safe zone within which entity 203 must always be. In embodiments, this safe zone may be a function of one or both of the alternative guardian 220, and the location 230 at which the temporary guardianship is to occur. In embodiments, the combined directive may also specify a time limit on any temporal guardianship of an alternative guardian. The example process flow of FIG. 2 continuously checks both of these conditions.

Continuing with reference to FIG. 2, the combined directive is applied at various locations 230 at which the entity may be during its day, such as, for example, school, home or playground, as shown. Thus, at query block 240 it is determined where the entity is with respect to the location it is then at, to see if entity 203 is within the directed safe zone. If the return at block 203 is "within safe zone", then process flow moves to block 245, for the second test, where it is determined if the time duration for the alternative guardianship, as directed by combined directive 210, has elapsed. If it has, and thus the return at query block 245 is "crossed time limit", then process flow moves to block 255, where alternative guardian is directed to hand off responsibility for entity 203 to primary guardian 207. However, if the return at query block 245 is "within time limit", then the alternate guardianship is proceeding without incident, and process flow moves back to block 230, where the location of entity 203 is ascertained so that the appropriate temporal and spatial limits of the guardianship are accessed for the next set of tests of query blocks 240 and 245.

It is here noted that, in embodiments, handoffs may be, and generally preferably are, automatic, given that the time of the handoff, the primary guardian 207, and the alternative guardian 220 receiving the handoff are all known to the system, via the combined directive 210. Thus, the checks at block 245 are only to pick up whether a scheduled automated handoff, for some reason, has not occurred. If it has not happened, then at block 255 a system alert is issued.

Returning now to query block 240, if the return at query block 240 is "outside of safe zone" then process flow moves to block 250, where primary guardian 207 is alerted.

Figure 3:
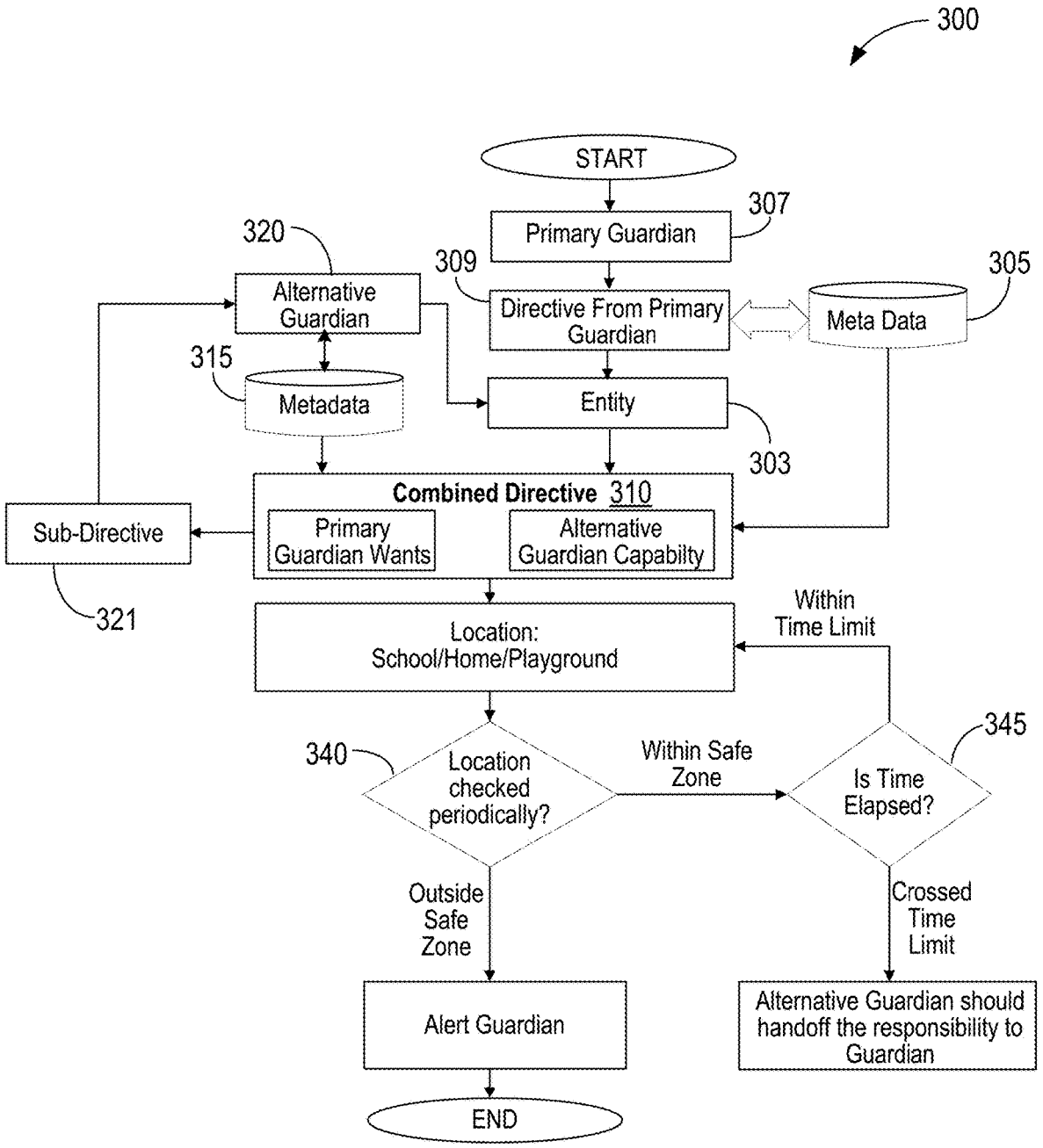
FIG. 3 illustrates an alternate version of the example process flow of FIG. 2, in accordance with various embodiments.

FIG. 3 illustrates process 300, which is a slight variation to process 200 of FIG. 2, in accordance with various embodiments. It is first noted that process 300 has the same blocks as does process 200 of FIG. 2, and thus the blocks of FIG. 3 have index numbers that only differ in the hundreds place digit, being a "3" for process 300 instead of a "2" for process 200. The difference between process 300 and process 200 is the arrangement of, and relationships between, primary guardian 307, alternative guardian 320, the directive from primary guardian 309, and metadata 315. It is only these blocks that are labeled in FIG. 3, with the exception of query blocks 340 and 345, the remaining blocks of process 300 being the same as their process 200 analogs shown in FIG. 2 and described above, and respectively having the same functionality.

With reference to FIG. 3, and by comparison with process 200 of FIG. 2, in process 300, alternative guardian 320 is a co-guardian to some degree with primary guardian 307 of entity 303, as shown. The co-guardianship arrangement is temporal in nature, but the time frame may be long, spanning days or weeks, and, for example, may occur when a trusted family member, such as a grandmother, or aunt, of entity 303 assists primary guardian 307 for a time when primary guardian 307, falls, for example, ill, goes out of town, or becomes temporarily unable to fully parent entity 303. Thus, alternative guardian 320 has access to metadata 315, which, in embodiments, may be a subset of metadata 305 extracted from sensor data transmitted by entity 303's device. Accordingly, in process 300 alternative guardian 320 has greater input to combined directive 310, as a result of his or her direct involvement with entity 303 for an extended time, and his or her trusted nature. In process 300, therefore, geographic and temporal restrictions on the alternative guardianship, queried for in query blocks 340 and 345, may be significantly relaxed.

Figure 4:
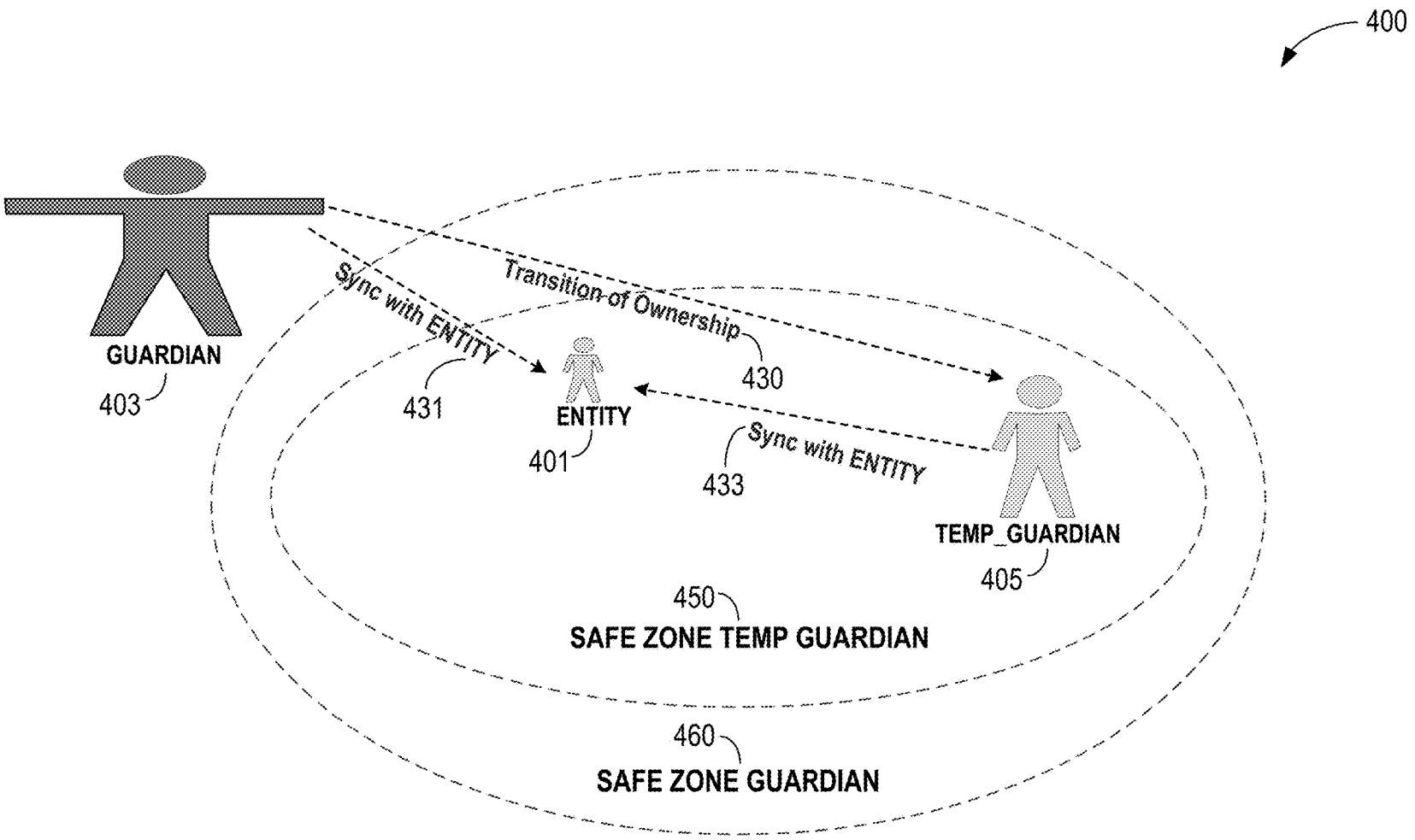
FIG. 4 illustrates example differing geographical safe zones for an example entity with reference to a primary guardian and a temporary guardian of the entity, in accordance with various embodiments.

FIG. 4 illustrates example differing geographical safe zones for an example entity with reference to a primary guardian and a temporary guardian of the entity, respectively, in accordance with various embodiments. With reference to FIG. 4, guardian 403 is a PG, with initial ownership of an entity 401. As such, guardian 403 has a device that has synchronized with an entity device (not shown) that is proximate to entity 401, as shown by arrow 431. As used herein, the term "synchronize with an entity" is a shorthand that refers to a device of a guardian synchronizing with an entity device. By using this shorthand, it is not necessary to always draw in a figure the guardian device and the entity device. For example, the entity device may be entity device 110 of FIG. 1, described above. While entity 401 is under the guardianship of guardian 403, it is free to move within safe zone 460, which may be set by a policy promulgated by guardian 403, as described above, or for example, by a system wide policy used in every type of guardianship managed by the system. As further shown in FIG. 4, there is a transition of ownership of entity 401 between guardian 403 and a second guardian, temp guardian 405, a TG, such as, for example, a teacher or a babysitter. The transition of ownership is indicated by arrow 430, and indicates that a communication path has been established between PG 403 and TG 405.

Although not shown in FIG. 4, in embodiments, the illustrated transition of ownership may be facilitated by a cloudlet server, such as, for example, cloudlet 120 of FIG. 1. To achieve a smooth hand-off between PG 403 and TG 405, TG 405 also synchronizes with entity 401, as shown by arrow 433, prior to the transition. As a result of the transition of ownership, in embodiments, a policy for TGs is sent to TG 405, which, in embodiments, includes an elastic boundary 450 in which entity 401 may move while under the ownership of TG 405. This elastic boundary is labelled as "safe zone temp guardian" in FIG. 4, and is, as shown wholly a subset of "safe zone guardian" 460.

Figure 5:
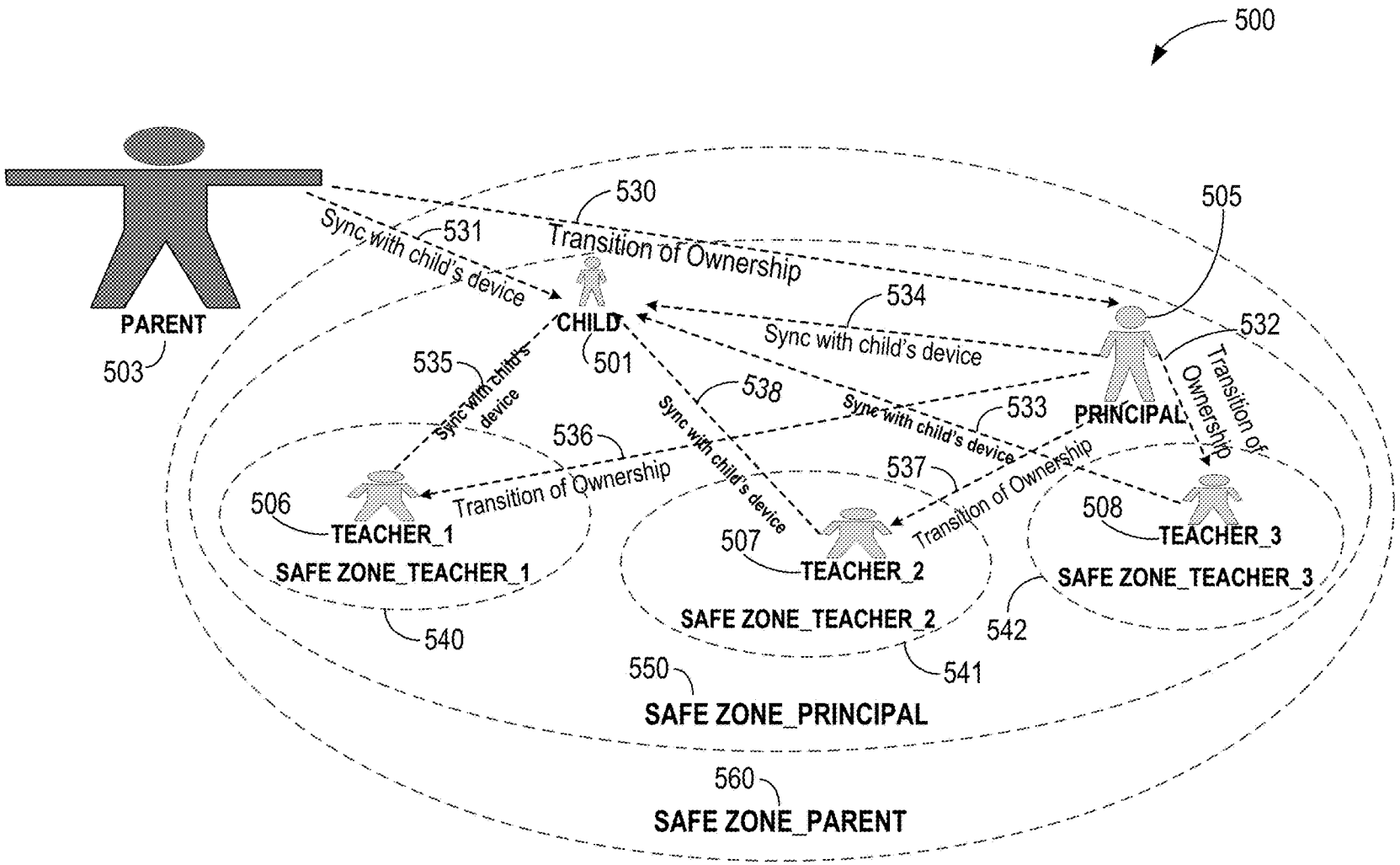
FIG. 5 illustrates example differing geographical safe zones for an example child entity with reference to a parent, a principal of the child's school, and three teachers at the child's school, respectively, in accordance with various embodiments.

FIG. 5 is a related, but more complex example than that of FIG. 4, specifically directed to a child entity example. FIG. 5 thus illustrates multiple example geographical safe zones for the child entity with reference to a parent, the PG, and several TGs: a principal of, and three teachers at, the child's school, in accordance with various embodiments. With reference to FIG. 5, guardian 503 is a PG, with initial ownership of a child 501. As such, guardian 503 has a device that has synchronized with the child's device (not shown) that is proximate to child 503, as shown by arrow 531. For example, the entity device may be entity device 110 of FIG. 1, described above. While entity 501 is under the guardianship of guardian 503, it is free to move within safe zone 560, the largest of the depicted safe zones, which encompasses all other safe zones, as shown. The sizes and boundary of the various depicted safe zones may be set by a policy promulgated by parent 503, or, for example, by a system wide policy used in every type of guardianship managed by the system, or the latter, but as may be allowably modified by a PG. As further shown in FIG. 5, there are multiple transitions of ownership of entity 501, and thus two levels of TGs. These transitions are next described.

Initially, parent 503 transitions his or her ownership of child 501 to principal 505 at the child's school. This initial transition of ownership is indicated by arrow 530, and indicates that a communication path has been established between parent 503 and principal 505. To effectuate this transition, principal 505 also synchronizes with the child's device, as shown by arrow 534. As a result of the transition of ownership, in embodiments, a policy for TGs is sent to principal 505, which, in embodiments, includes an elastic boundary 450 in which child 501 may move while under the ownership of principal 505. This elastic boundary is labelled as "safe zone principal" in FIG. 5, and, as shown, is a wholly contained subset of "safe zone parent" 560. In embodiments, the policy that controls the boundaries of the various safe zones of FIG. 5 may be specific to child 501, to the school, to either of principal 505, and teachers 506, 507 and 508, or it may be a standard policy of parent 503, or of the system in general, applicable to children or other entities involving two or more tiers of TGs. In embodiments, there is great flexibility in setting policies and modifying them to respond to varying contexts and entities.

Following that initial transition, and according to the relevant policy in effect for guardianship of child 501, principal 505 then successively transitions ownership of entity 501 to each of Teacher_1 506, Teacher_2 507 and Teacher_3 508, which may be, for example, the teachers of child 501 throughout his day at school. Each time the child moves classes, the teacher of the new class receives ownership of child 501 from principal 505. In embodiments, each of Teacher_1 506, Teacher_2 507 and Teacher_3 508 are accountable to both principal 505 and to parent 503, in the event of any violation of policy.

Initially, as shown by arrow 536, principal 505 transitions ownership of child 501 to Teacher_1 506. As above, to facilitate a smooth hand-off, Teacher_1 506 synchronizes with child's device, as shown by arrow 535. Once ownership passes to Teacher_1 506, child 501 is limited to move within the elastic boundary "safe zone_teacher-1" 540. In embodiments, if child is determined to be outside of this elastic boundary, such as, for example, by analysis of sensor data received from child's device, a system server, such as, for example, cloudlet 120 of FIG. 1, sends alerts to Teacher_1 506, principal 505 and parent 503. It is assumed in the example of FIG. 5 that at the end of the child's class with Teacher_1 506, Teacher_1 506 returns ownership of child 501 to principal 505. Alternatively, each teacher may directly transfer ownership of child 501 to the next teacher, without using principal 505 as a middleman.

In similar fashion as the above described transition of ownership to Teacher_1 506, principal transitions ownership to each of Teacher_2 507 and Teacher_3 508, as shown by arrows 537 and 532, respectively. At the time of each transition, the teacher receiving ownership synchronizes their device with the entity device, as shown by arrows 538 and 533, respectively. While under the ownership of each teacher, as was the case for Teacher_1 506, entity 501 is restricted by an elastic boundary specific to that teacher, as shown by "safe zone_teacher_2" 541, and "safe zone_teacher_3" 542, respectively. In embodiments, following the last teacher's ownership, at the end of the school day, for example, Teacher_3 508 may transition ownership of entity 501 directly back to parent 503, or to principal 505, who may then transition ownership back to parent 503.

Figure 6:
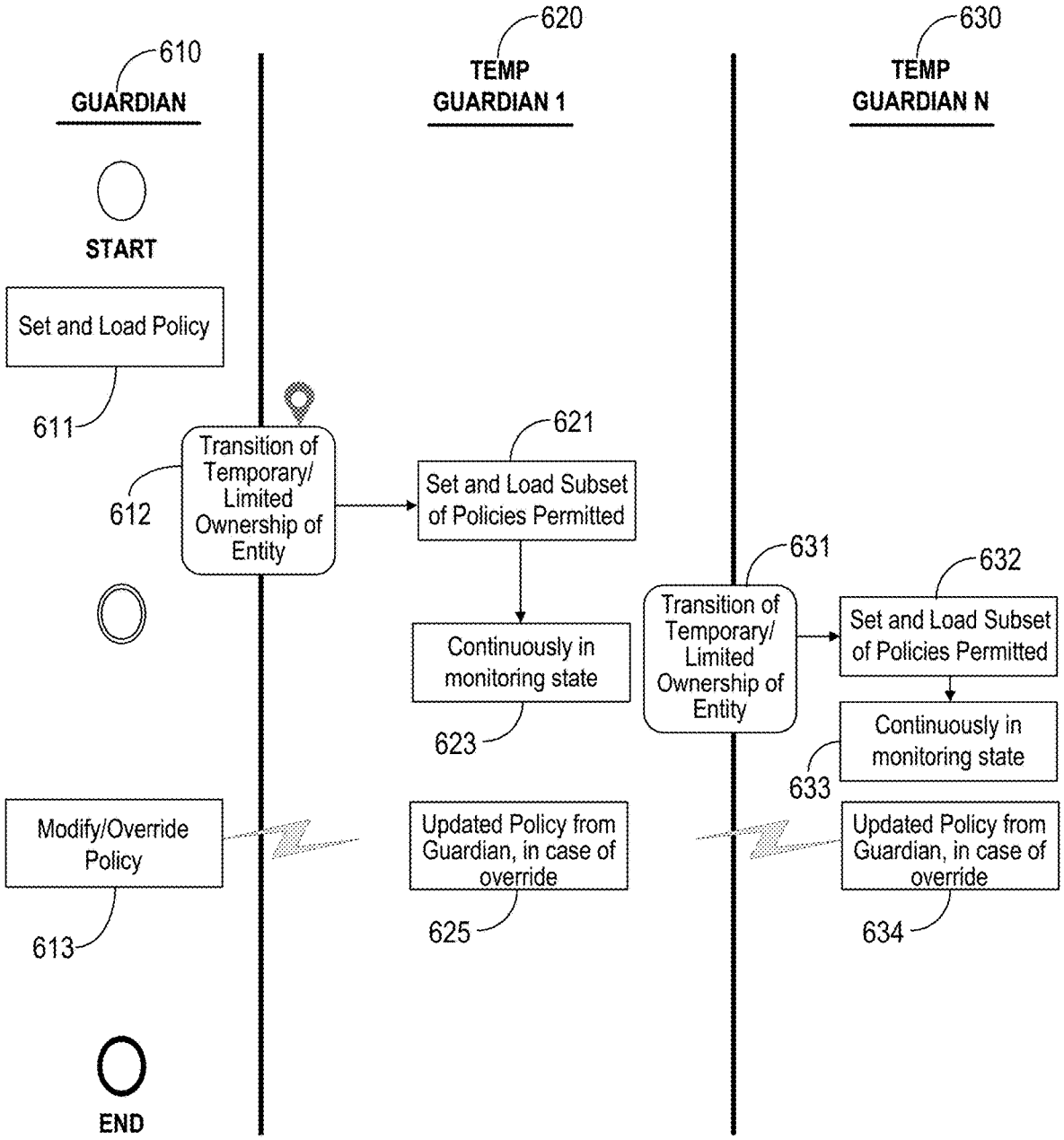
FIG. 6 illustrates an example process for setting guardianship policies and performing consecutive transitions between multiple temporary guardians, in accordance with various embodiments.

Considering the multi-guardian example illustrated in FIG. 5, FIG. 6, next described, illustrates an example process for setting guardianship policies and performing consecutive transitions between multiple temporary guardians, within an example system, such as a guardianship management service, in accordance with various embodiments. In the example process of FIG. 6, unlike the example of FIG. 5, a TG directly transitions ownership of an entity to a subsequent TG.

Following FIG. 6, details of vetting the legitimacy of a transition of ownership between guardians are described with reference to the example process flow of FIG. 7, and following that, details of defining rules and synchronizing a PG's device with a TG's device, according to the defined rules and policies, are described with reference to the example process flow of FIG. 8. The various process flows of FIGS. 6-8 may be performed, for example, by a processor, such as a processor of cloudlet 120 of FIG. 1, or, for example, by processors 1203 of FIG. 12.

With reference to FIG. 6, at block 611, a guardian 610 sets and loads a policy. The policy may be uploaded to a cloudlet server, such as cloudlet 120 of FIG. 1. The policy covers an entity, and may cover several entities, as described above. At block 612, guardian 610 transitions temporary ownership of the entity, for a limited time, to temporary guardian 1 620, who, at block 621, sets and loads a subset of policies, specific to his or her guardianship of the entity, that are permitted by the policy set by guardian 610. For example, temporary guardian 1 620 may have a more stringent elastic boundary for the entity while it is under their control, or the entity, while under the care of temporary guardian 1 620, may be restricted from interacting with other entities also under the control of temporary guardian 1 620. As shown in block 623, the entity is continuously in a monitoring state by the system while in the temporary guardianship.

Continuing with reference to FIG. 6, at block 631, temporary guardian 1 620 transitions limited ownership of the entity to temporary guardian N 630, who, at block 632, sets and loads a subset of policies, specific to his or her guardianship of the entity, that are permitted by the policy set by guardian 610. For example, temporary guardian N 630 may have a more stringent, or more lenient, elastic boundary for the entity while it is under their control, relative to that of temporary guardian 1, or the entity, while under the care of temporary guardian N, may be restricted from eating certain foods likely to be available while under the control of temporary guardian N 630. As shown in block 633, the entity is continuously in a monitoring state by the system while in the temporary guardianship.

During any temporary guardianship, guardian 610 may modify or override any policy relative to the entity. Such a change in policy then directly affects the terms under which the entity is cared for by a temporary guardian. Thus, at block 613 guardian 610 modifies or overrides the policy initially set at block 611, and this change in policy is communicated, through the system, such as, for example, via UAC 155 of FIG. 1, from guardian 610 to temporary guardian 1, as shown in block 625, and/or to temporary guardian N, as shown at block 634. Given that the entity is continuously monitored while under the care of temporary guardians, any modification or override in policy at block 613 may trigger violations of the modified policy, which, due to the entity being continuously monitored, will trigger alerts to guardian 610.

Referring again to blocks 612 and 631 of FIG. 6, at each of these blocks a transition of a temporary or limited ownership of the entity from one guardian to another is shown. FIG. 7 presents details of verification of the legitimacy of such transitions, in accordance with various embodiments.

Figure 7:
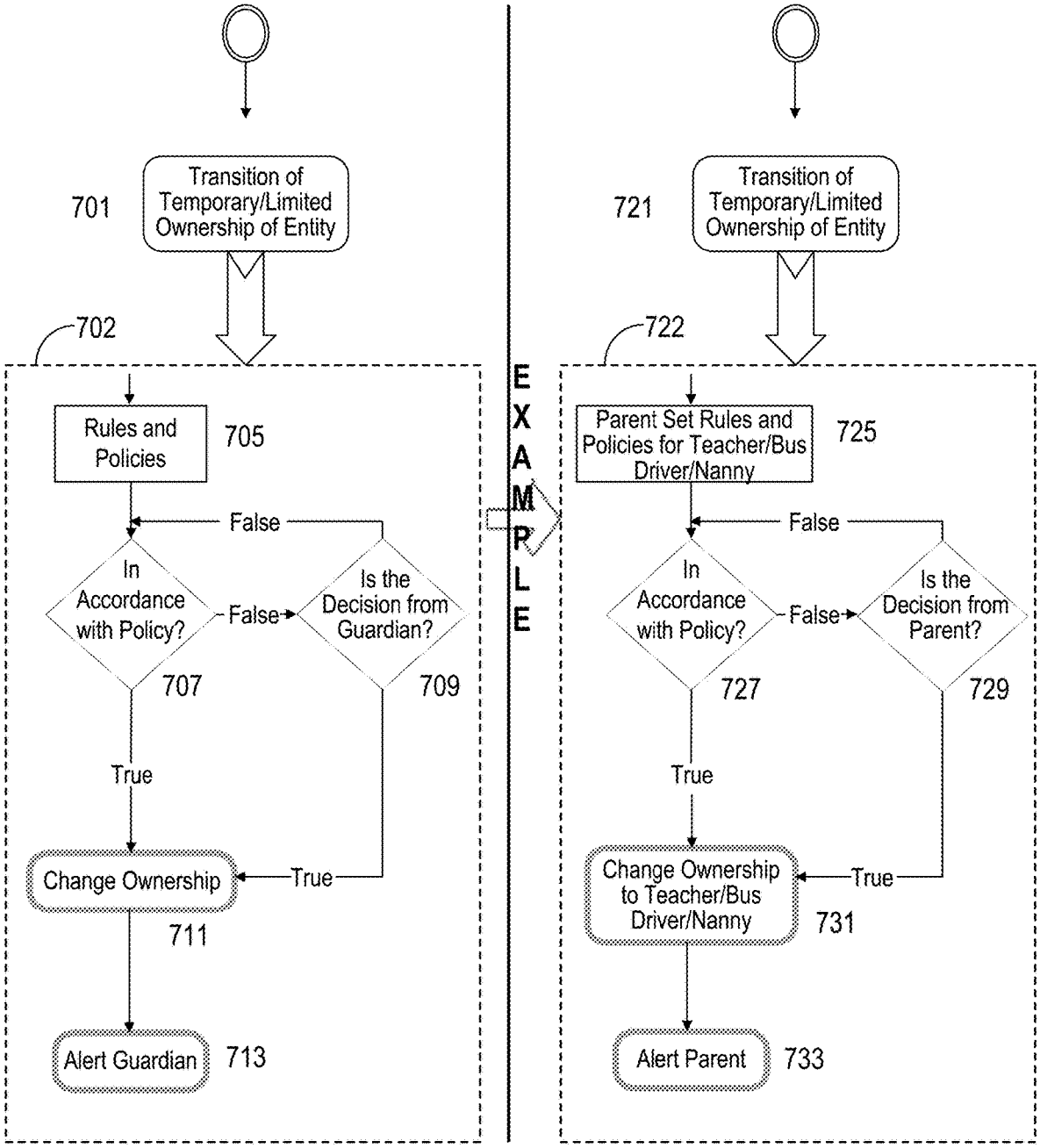
FIG. 7 illustrates details of example transitional states between a guardian and a temporary guardian, or between a first temporary guardian and a second temporary guardian, as shown in FIG. 6, in accordance with various embodiments.

With reference to FIG. 7, both an example general process flow for verification of a legitimacy of transition of temporary or limited ownership of an entity, and a specific instance of the example general process flow, are shown. The left side of FIG. 7, including blocks 701 through 713, illustrates the general process flow, and the right side of FIG. 7, including blocks 721 through 733, illustrates a specific example of that flow for a parent PG and a child entity. For ease of comparison between the left and right sides of FIG. 7, index numbers of blocks on the right side differ from index numbers of the analogous blocks on the left side by twenty, so the first and third digits of each analogous index number are identical.

Continuing with reference to FIG. 7, first describing the general process flow of the left side, at block 701 a transition of temporary or limited ownership of an entity is initiated. It may initiated by Block 701 is, for example, the same block as block 612, or as block 631, of FIG. 6. From block 701, process flow moves to block 705, which is included in superblock 702. Superblock 702 includes that portion of the example general process flow that is instantiated with specifics in the analogous superblock 722, on the right side of FIG. 7. With reference to block 705, upon receipt of the initiation of the transition of guardianship, at block 705 rules and policies set by the primary guardian are consulted, so as to be able to vet the legitimacy of the initiated transition. For example, the rules and policies may be those set and loaded by the PG at block 611 of FIG. 6, described above.

Continuing with reference to FIG. 7, from block 705 process flow moves to query block 707, where it is determined whether the proposed transition is in accordance with the governing policy. It is here noted that even if the guardian knows the temporary guardian, example systems according to various embodiments serve as a double check, and if the proposed transition of guardianship is not in accordance with policy, the guardian himself is alerted and must override the policy, in order to proceed with the transition. Thus, if the return at query block 707 is True, and the proposed transition is in accordance with existing rules and policies, process flow moves to block 711, and the change in ownership of the entity is implemented. Finally, from block 711 process flow moves to block 713, where the guardian is alerted as to the change.

However, if the return to query block 707 is False, then process flow moves to query block 709, where it is determined if the decision to transition guardianship of the entity was made by the guardian. If the return at query block 709 is True, and the proposed transition, although not accordance with existing rules and policies, is nonetheless desired by the guardian, and thus the policy is effectively overruled, then process flow moves to block 711, and the change in ownership of the entity is implemented. However, if the return to query block 709 is False, then process flow returns to query block 709, and, for example, continues through a loop of query blocks 707 and 709 until the rules and policies are changed (e.g., by a modification or override of policy as shown at block 613 of FIG. 6), so as to allow the transition at query block 707, or the guardian allows the transition, albeit against rules and policies, at query block 709.

On the right side of FIG. 7, blocks 725 through 733 follow the same process flow as described above for blocks 705 through 713, with a few exceptions. First, instead of a generic "guardian" this example refers to a parent, and thus the entity is a child of that parent. Additionally, the rules and policies at block 725 are those set by the parent for temporary guardians relating to the child's school and after school care, covering teachers, bus drivers and nannies. The parent may override the rules and policies at query block 729, and at block 731, when ownership of the child is changed, it is changed to one of the TGs addressed in rules and policies 725, namely a teacher, bus driver or nanny. Finally, at block 731, the alert is sent by an example system, to the parent.

Figure 8:
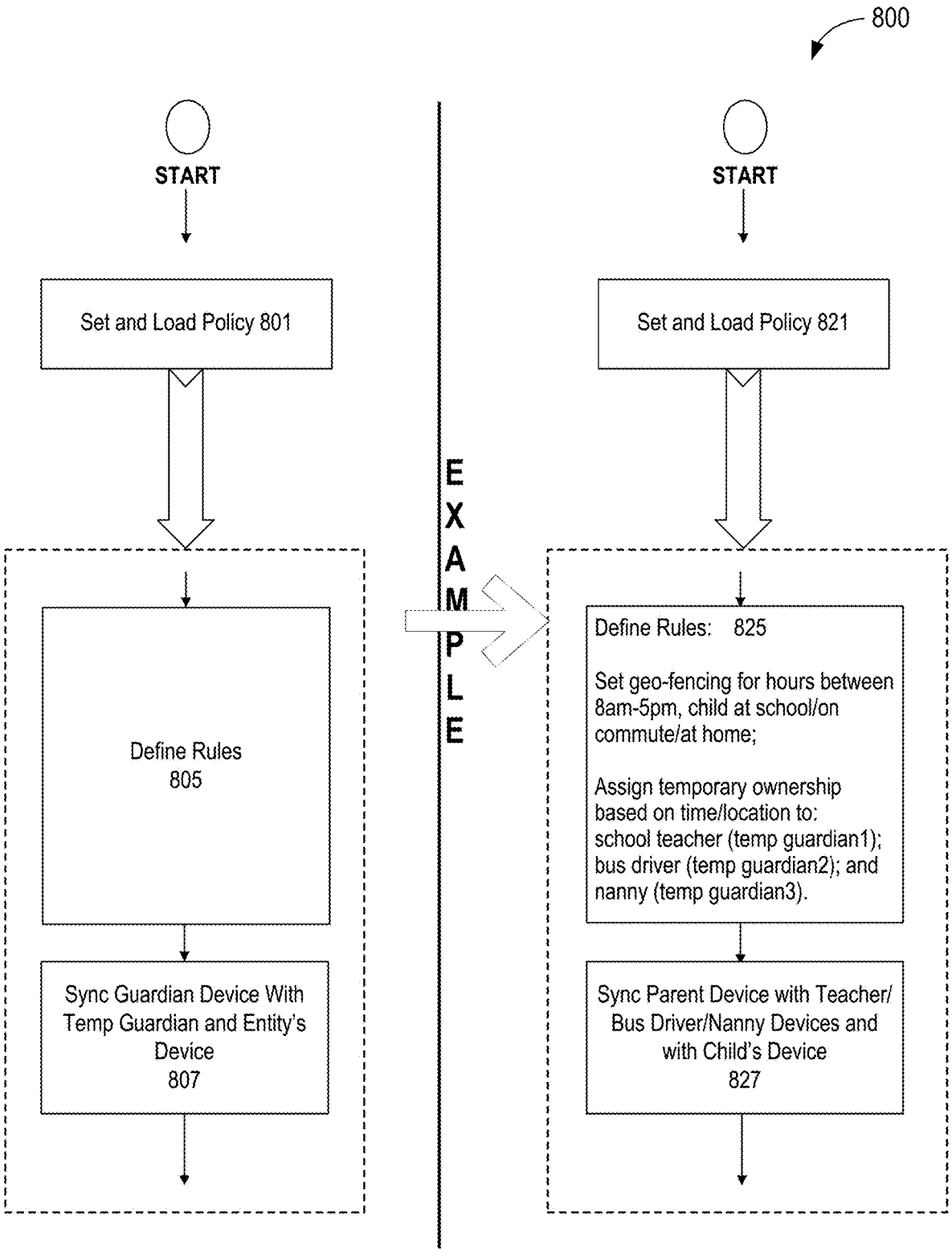
FIG. 8 illustrates details of defining rules and synchronizing a primary guardian's device with a temporary guardian's device to effect transitions of ownership of an entity pursuant to those rules, such as are illustrated in FIGS. 6 and 7, in accordance with various embodiments.

FIG. 8 illustrates details of defining rules and synchronizing a PGs device with a TG's device to effect transitions of ownership of an entity pursuant to those rules, such as is illustrated in FIGS. 6 and 7, in accordance with various embodiments. As was the case in FIG. 7, in FIG. 8 both an example general process flow for defining rules of a policy for assigning temporary ownership of an entity, and synchronizing respective devices of guardian and entity, and a specific instance of the example general process flow, are shown. The left side of FIG. 8, including blocks 805 and 807 illustrates the general process flow, and the right side of FIG. 8, including blocks 825 and 827, illustrates a specific example of that flow for the specific example used in the right side of FIG. 7, a parent guardian and a child entity.

Continuing with reference to FIG. 8, first describing the general process flow depicted on the left side, at block 801 a policy is set and loaded. This block is equivalent to block 611 of FIG. 6, described above. From block 801, process flow moves to block 805, where rules pursuant to, or implementing, the policy, are defined. From block 805, process flow moves to block 807, where a guardian device is synchronized with a temporary guardian's device and the entity's device. The functionality performed at block 807 is equivalent to that illustrated in FIG. 4, and described above, and need not be described again.

On the right side of FIG. 8, blocks 825 and 827 follow the same process flow as described above for blocks 805 and 807, for the specific example instance of a parent guardian and a child entity, as described above with reference to FIG. 5 and the right side of FIG. 7. Thus, at block 825 the rules that are defined include geo-fencing (e.g., elastic boundaries) for the child for several segments of the day, covering, in the aggregate, the hours of 8:00 am through 5:00 pm, and addressing several types of temporary guardian, to whom ownership of the child is temporarily transitioned, as described above, with reference to FIG. 6. The geo-fencing covers the temporary guardianships of a teacher at school, a bus driver while the child is on a commute home from school, and a nanny while watching the child at his or her home after school. From block 825, process flow moves to block 827, where the parent device is synchronized with the child's device as well as with the devices of the respective temporary guardians.

Figure 9:
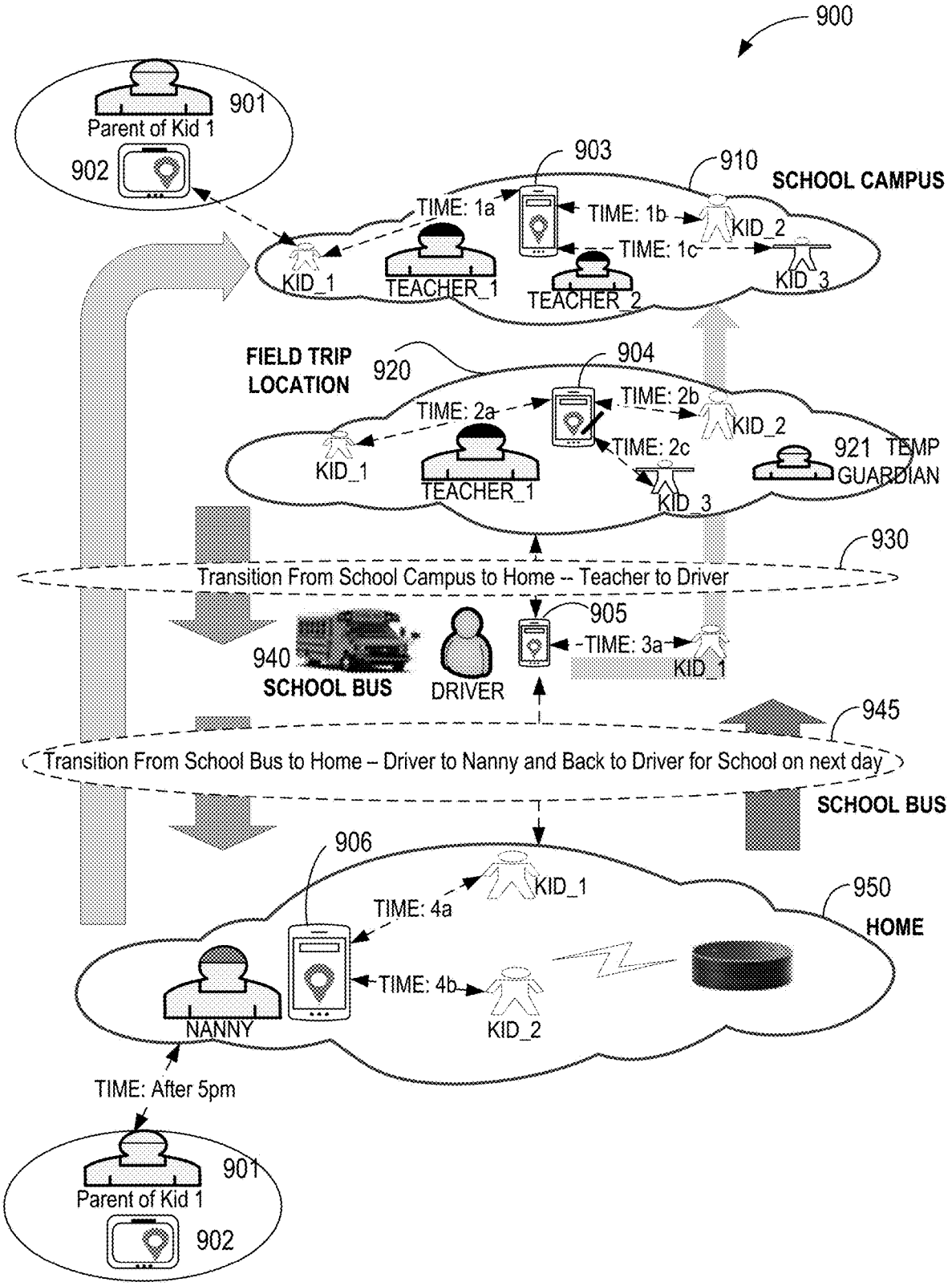
FIG. 9 illustrates a detailed example use case for managing various transitions of ownership of a school age child during an example school day between several guardians, in accordance with various embodiments.

FIG. 9 illustrates an example use case for managing various transitions of guardianship for a school age child during an example school day, in accordance with various embodiments. The example use case shown in FIG. 9 is thus very similar to, but with greater detail, the specific instance of a guardian and entity shown in the right sides of each of FIGS. 7 and 8. Accordingly, the example use case shown in FIG. 9 illustrates guardianship management for a child that includes securely tracking the child based on a schedule, similar to that shown in block 825 of FIG. 8, that begins at the child's home, transitions to the child's school for the hours of 8:00 am-1:00 pm, transitions to a bus driver from 1:00 pm-1:30 pm when the child is driven home, and then at 1:30 pm transitions back to the child's home. At the child's home, from 1:30 pm-5:00 pm the child is supervised by a nanny, and, at 5:00 pm there is a final transition of guardian to the child's parents. The tracked schedule thus includes several intermediate transitions from parents to teacher, teacher to school bus driver, school bus driver to nanny and finally nanny to parent, when the parent returns from work.

Continuing with reference to FIG. 9, at the beginning of the example schedule, prior to dropping off the child at school campus 910 at 8:00 am, Parent of Kid 1 901 provides, via their smartphone 902, a day plan for the child before transitioning guardianship to a school teacher, Teacher_1. Parent of Kid 1 901 may be either, or both, of Kid_1's parents, for example. In embodiments, the day plan may be already stored in an example system, and in that case, Parent of Kid 1 901 may choose, on their device, from one of their one or more stored day plans and advise the system to implement its pre-existing policies. This would be the case, for example, for a repeated daily routine for the entity, such as, for example, a school day, or a specific day of the week school day (e.g., Tuesdays), or a summer camp day, or a visitation day with a non-custodial parent where the parents are divorced, where the entity's schedule, and one or more TGs who assume care of the entity pursuant to that schedule, are the same for many days. Alternatively, Parent of Kid 1 901 may, for example, create a new day plan, or modify an existing day plan already stored in the system, for example.

In embodiments, for each designated locale where Kid_1 is scheduled to be according to the day plan, an elastic boundary is also provided. It is via the elastic boundaries that, in embodiments, an entity is virtually tied to a TG, or to both a PG and a TG during any portion of the entity's day. For example, the day plan may include that Kid_1 should be within a specified elastic boundary (virtual fence) during Time 1*a*, for example, between 8:00 am to 1:00 pm, at school campus 910. As shown in FIG. 9, two other children, Kid_2 and Kid_3, are also under guardianships of Teacher_1 and Teacher_2, respectively, at school campus 910, each for a specified time interval of Time 1*b* and Time 1*c*, respectively. These time intervals may be the same as, or may be different than, Time 1*a* for the guardianship of Kid_1, for example. In embodiments, the elastic boundaries may be static, and thus defined in absolute co-ordinates, or, for example, they may be dynamic, and defined relative to the co-ordinates of the PG and one or more TGs. In such embodiments that use a dynamic elastic boundary, an example server, such as cloudlet 120 of FIG. 1, periodically (which may be effectively continually, as may be provided by the policy) tracks the positions of both the entity and one or more guardians throughout each guardianship, and determines, as shown, for example, at block 240 of FIG. 2, the relative distance between the entity and the TG. Or, for example, both the PG and the TG, where there are nested elastic boundaries, such as is shown, for example, in FIG. 4 (e.g., safe zones 450 and 460), and described above.

Thus, as shown in FIG. 9, at every stage of its day a device proximate to Kid_1, which may be a device worn by Kid_1, establishes a paired connection with a TG for a stipulated time interval, at the end of which, for example, there is a handoff to the next scheduled TG. The paired connection is communicated to an example server, which then monitors the entity and the TG's positions, and performs periodic checks. It is noted that, in embodiments, these handoffs are automatic, given that the time of the handoff, and the identities of the PG handing off to a TG, or of a first TG handing off to a second TG, and the entity, are all known to the system, via the day plan selected, or uploaded, by Parent of Kid 1 901, as noted above.

For example, when Parent of Kid 1 901 drops Kid_1 off at school at 8:00 am, until Kid_1 enters school campus 910 and Kid_1's device automatically establishes a secured connection with his or her teacher's device, here Teacher_1's device 903. At this time Parent of Kid 1's device 902 remains paired to Kid_1 (e.g., Kid_1's wearable device) and waits for notification of a smooth handoff to Teacher_1's device 903. As described above, in embodiments, the handoff is automatic, and occurs once Teacher_1's device 903 synchronizes to Kid_1's device, and that fact is registered by an example guardianship management system, such as may run on cloudlet 120 of FIG. 1. Once the handoff occurs, in embodiments, the devices of both Parent of Kid 1, and Teacher_1 are notified, such as, for example, via messaging module 159 of FIG. 1. In embodiments, a parent device and a TG device run a client application provided by the purveyor of a guardianship management system, that also operates a server, such as cloudlet 120 of FIG. 1.

In embodiments, when a handoff occurs, the role of the handing off guardian post handoff may vary, as a function of their place in the hierarchy of guardians for the entity, as well as the policy. Thus, for example, with reference to FIG. 9, when an automatic handoff from Parent of Kid 1 901 to Teacher_1 occurs, Kid_1 is then under the direct care of Teacher_1, who is accountable and responsible for Kid_1. Thus, Teacher_1 receives a continual feed of a metadata stream regarding Kid_1 from a guardianship management system, such as, for example, metadata stream 150 from cloudlet 120, as illustrated in FIG. 1. The handing off guardian may, for example, receive all or a part of the metadata stream, as may be defined in the policy. For example, some parents wish to micro-manage any guardian and thus want all available data regarding the entity, at all times. Other parents are more hands off, and only wish to be alerted if a violation of a then governing policy, to some defined degree of policy defined severity, occurs, such as, for example a 10 yard or greater violation of an elastic boundary. Or, for example, a greater than 3 yard violation of the elastic boundary, if the violation is the third such violation within an hour. In embodiments, in general a PG may be informed as to any violation of a policy or restriction, based on frequency of occurrence, severity, comfort level with the then acting TG, or any combination of these variables.

When the handoff of ownership of the entity is between two different TGs, the degree of data to be sent to the handing off TG depends upon whether the handing off TG retains accountability in some way. For example, as shown in FIG. 1, Guardian #3 162, a sub TG, is delegated by Guardian #2 161, a TG. Thus, in embodiments, Guardian #2 161 may retain accountability for entity 101, even though entity 101 is, post handoff, under the primary care of Guardian #3 162. As such, Guardian #2 161, and possibly Guardian #1 160, may each receive all or a subset of metadata stream 150 that is sent to the then active guardian, Guardian #3 162. This is the situation illustrated, for example, in FIG. 5, where school principal 505, although transferring ownership of child 501 to each of Teacher_1 506, Teacher_2 506 and Teacher_3 508 successively, as child 501 moves form class to class during her school day, may remain ultimately responsible for the guardianship activities of these TGs, all of whom are his employees. Thus, there is always, in the example of FIG. 5, a relationship between child 510 and principal 505, while child 501 is at school, including while under the care of each of his teachers throughout the school day. In this example of FIG. 5, principal 505 may receive the same data stream that each teacher receives, as any violation is expected to be dealt with by principal 505. Parent 503 may, or may not, receive the same full data stream, as parent 503 may choose, via a policy, or a modification of the policy at any time during the guardianships of child 510 at school, as is illustrated in block 613 of FIG. 6, for example.

Thus, in embodiments, a guardianship may have multiple layers of guardians, each virtually connected to an example entity, where an elastic boundary is associated with each, or some of, the guardians, and where, for example, a (monitored) communications channel is facilitated. It is noted, however, that when a PG and a TG are in close proximity, and the entity has been handed off to the TG, even though the PG may remain virtually tied to the entity, and even though the PG may receive an equal or greater metadata stream descriptive of the entity's location and activities, there is only one directly responsible guardian at a time, unless a policy provides for co-guardians, such as, for example, where a pair of TGs watch the entity together, with equal authority. Thus, once a PG hands off ownership of an entity to a TG, the TG is primarily responsible, and the periodic checks of the guardianship by a cloudlet server, such as illustrated in FIG. 2, at blocks 240, 245, 250 and 255, are with reference to the TG or alternative guardian 220.

Continuing with reference to FIG. 9, Teacher_1 may, for example, have a hand held device, or alternatively may have an application on a smart device 903 that tracks all of the children in his or her class. In embodiments, the application is a client side application provided by an example guardianship management system, such as is illustrated in FIG. 1, to which any client device connects over a network, such as the Internet, or a private network, such as a VPN maintained by a guardianship management service. In embodiments, there may be, for example, two teachers in the class, each of which has the guardianship management application, for example, which application communicates with a cloud based server managing the guardianships for Kid_1. Once a connection is established between Kid_1's wearable device and Teacher_1's device, the elastic boundaries specified in the day plan (unless overridden by a higher priority policy of the system or a PG) are implemented during the specified school hours, for example, 8:00 am to 1:00 pm, and if there is any deviation from those boundaries, during that time interval, an alert is sent to Teacher_1 (and possibly a principal and the parent of Kid_1) stating that Kid_1 needs attention, or alternatively, that there is an emergency. In some embodiments, an alert for every deviation from an elastic boundary is sent to the child's parents, and in alternate embodiments, only deviations that are identified as serious trigger such an alert.

Continuing with reference to FIG. 9, on a day when a field trip is scheduled, for example, during Time 2*a,* 11:00 am-1:00 pm, which is a subset of school hours 8:00 am-1:00 pm, and thus on that day Kid_1 will not return back to school campus 910 at the end of the field trip, the day plan provided by Parent of Kid 1 901 may provide for a change of guardianship to a temporary guardian 921 for the duration of the field trip, and may specify that, at the transition, a location of a virtual fence is changed from school campus location 910 to field trip location 920. This creates an elastic boundary for Kid_1 at field trip location 920 during Time 2*a*. As above, it may be static, defined by proximity to field trip location 920, or dynamic, defined relative to Teacher_1 and/or temp guardian 921. Moreover, a teacher assigned to Kid_1 for the field trip, such as, for example, one or both of Teacher_1 or Temp Guardian 921, may have a similar connection with Kid_1's wearable device, through for example, a hand held device, or alternatively a client application of a guardianship management system provided on a smart device 904 that tracks all of the children at field trip location 920.

Once the field trip is over, or, on days when there is no field trip, guardianship of Kid_1 next transitions smoothly between, for example, Teacher_1 and a school bus Driver. As above, in embodiments, this transition is automatic, occurring when the proper device synchronizations occur. This transition is shown at block 930 of FIG. 9. During transition 930, school bus Driver's hand held device 905 is paired with Kid_1's wearable device, to ensure safety of the entity, Kid_1, during travel time of 1:00 pm to 1:30 pm, while Kid_1 is on school bus 940. The pairing, and the subsequent guardianship of Driver, is managed by a cloud server, as described above.

As shown in FIG. 9, a next transition occurs between (school bus) Driver and a Nanny who watches Kid_1 at home 950, for example between 1:30 pm to 5:00 pm until Parent of Kid 1 901 returns home from work. In embodiments, once Nanny is near School Bus 940, her device and Kid_1's wearable device are automatically paired (being both informed of the planned transition by, for example cloudlet server 120), and a hand off mechanism occurs between Driver and Nanny for security and smooth transition. In embodiments, Nanny's device 906 remains paired with Kid_1's wearable device until the end of the day, for example, at 5:00 pm, when Kid_1's parents are back at home 950. While Nanny's temporary guardianship is in effect, an elastic boundary may be established at home 950, to ensure that Kid_1 stays within the specified boundary limits set by a policy provided by Kid_1's parents. Whenever there is deviation from these boundary limits, an alert to Parent of Kid 1 may be sent, depending upon the threshold criteria for an alert, as described above. Finally, when Kid_1's parents arrive back at home there is a final handoff mechanism between Nanny and Parent of Kid 1, and Kid_1 remains in the care of his or her parents until the next morning.

In embodiments, a temporary connection between a TG and an entity, for example, Kid_1, is lost once a hand off mechanism between successive TGs is successfully completed, unless, as described above, a handing off TG retains some responsibility for the new TG, or overall supervisory responsibility for the entity during the guardianship of the TG.

In embodiments, if there is an exception to the scheduled transitions, such as, for example, a traffic jam during the transition from school to field trip, or from field trip or school to home, which operates to delay significantly the next scheduled transition, a PG, for example, Parent of Kid 1 901 may check with the relevant TG or TGs, e.g., Teacher, Driver or Nanny, or even the entity, via a facilitated communications channel by an example guardianship management system, and change, on the fly, timing of specified elastic boundaries from those specified in the original schedule for the entity.

In embodiments, a PG, such as, for example, a parent, may have a permanent virtual connection with an entity's proximate device so as to be able to receive any alerts. Then, in case of, for example, any deviation from specified elastic boundaries, suspicious situations (e.g., failure of a scheduled pairing between TG device and entity wearable device, unauthorized device pairing by an unknown intruder, etc.), emergency situations, or other need for tracking the entity's location, an alert may be sent.

Figure 10:
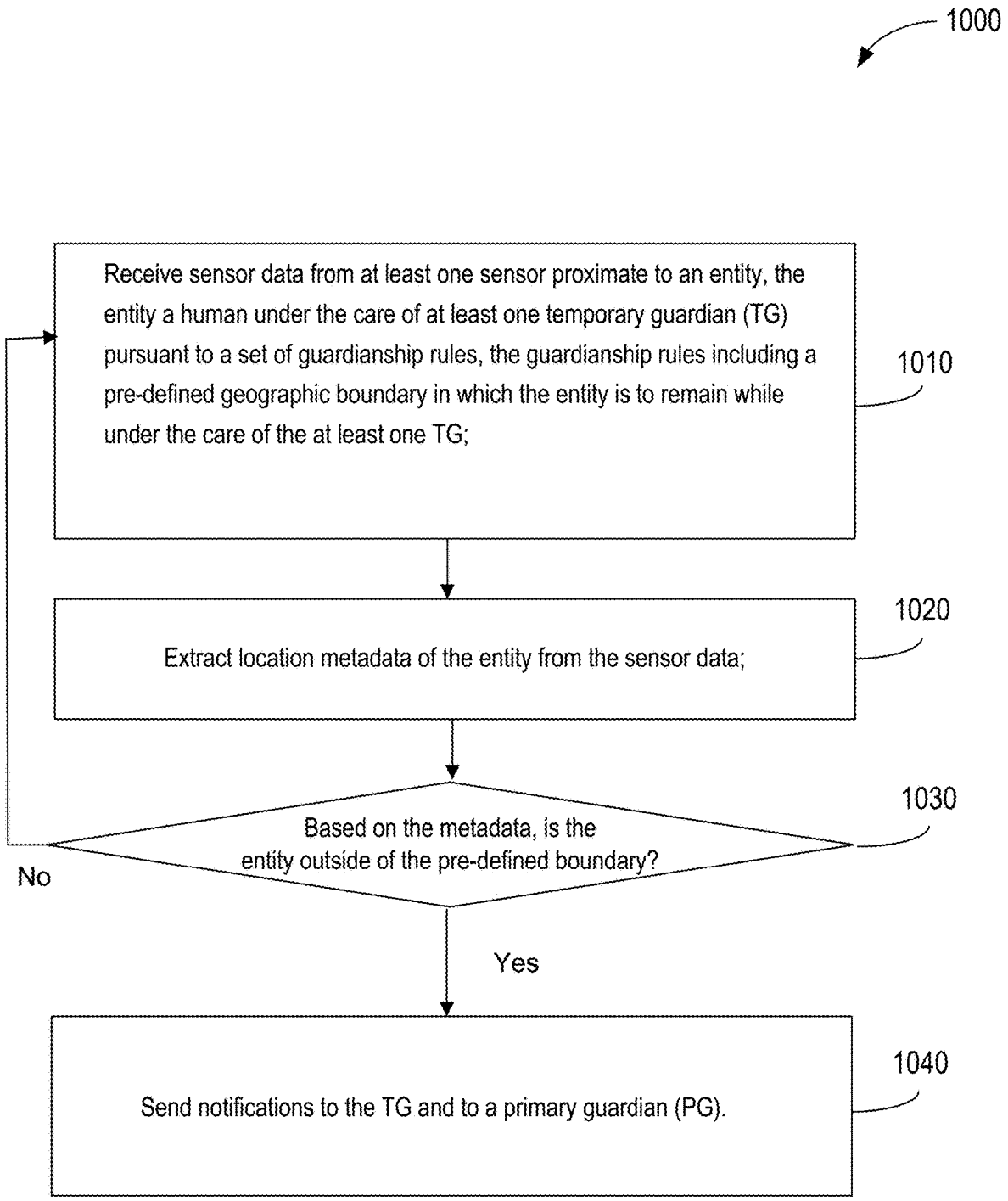
FIG. 10 illustrates an overview of the operational flow of a process for receiving sensor data from sensors proximate to an entity, extracting location metadata from the sensor data, and determining of the entity is outside a pre-defined geographic boundary, in accordance with various embodiments.

Referring now to FIG. 10, an overview of the operational flow of a process for receiving sensor data from sensors proximate to an entity, extracting location metadata from the sensor data, and determining if the entity is outside a pre-defined geographic boundary, in accordance with various embodiments, is presented.

Figure 12:
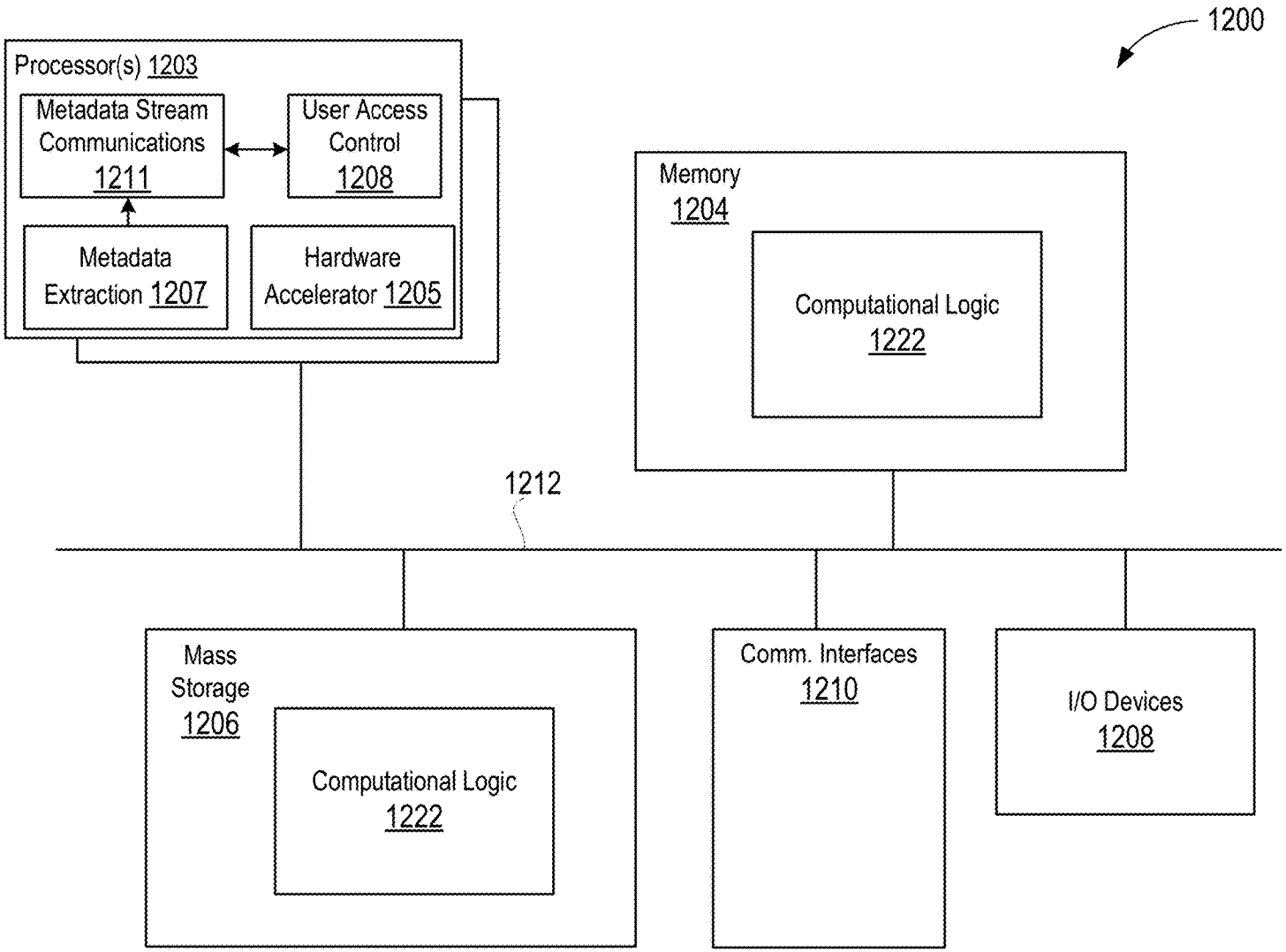
FIG. 12 illustrates a block diagram of a computer device suitable for practicing the present disclosure, in accordance with various embodiments.

Process 1000 may be performed, for example, by a CPU or processor, such as processor 1202 of FIG. 12, or a cloudlet server 120, as shown in FIG. 1, in accordance with various embodiments. Process 1000 may include blocks 1010 through 1040. In alternate embodiments, process 1000 may have more or less operations, and some of the operations may be performed in different order.

With reference to FIG. 10, process 1000 begins at block 1010, where sensor data from at least one sensor proximate to an entity is received, the entity being a human under the care of at least one TG pursuant to a set of guardianship rules, the guardianship rules including a pre-defined geographic boundary in which the entity is to remain while under the care of the at least one TG.

From block 1010, process 1000 proceeds to block 1020, where location metadata of the entity is extracted from the sensor data.

From block 1020, process 1000 proceeds to query block 1030, where it is determined, based on the extracted location metadata, if the entity is outside of the pre-defined boundary included in the guardianship rules. The geographic boundary may be, for example, any of the safe zones depicted in FIG. 5, depending upon whether the TG at the time is a teacher or a principal. If "Yes" at query block 1030, then process 1000 moves to block 1040, where notifications to both the TG and the PG are sent. However, if "No" is returned at query block 1030, and thus the entity is within the geographic area that he or she should be, as provided in the guardianship rules applying to the then TG's guardianship, then process 1000 returns to block 1010, and receives an updated set of sensor data regarding the entity.

Thus, process 1000 may function as a continuous loop, to check on the location of the entity during the guardianship of any TG.

Figure 11:
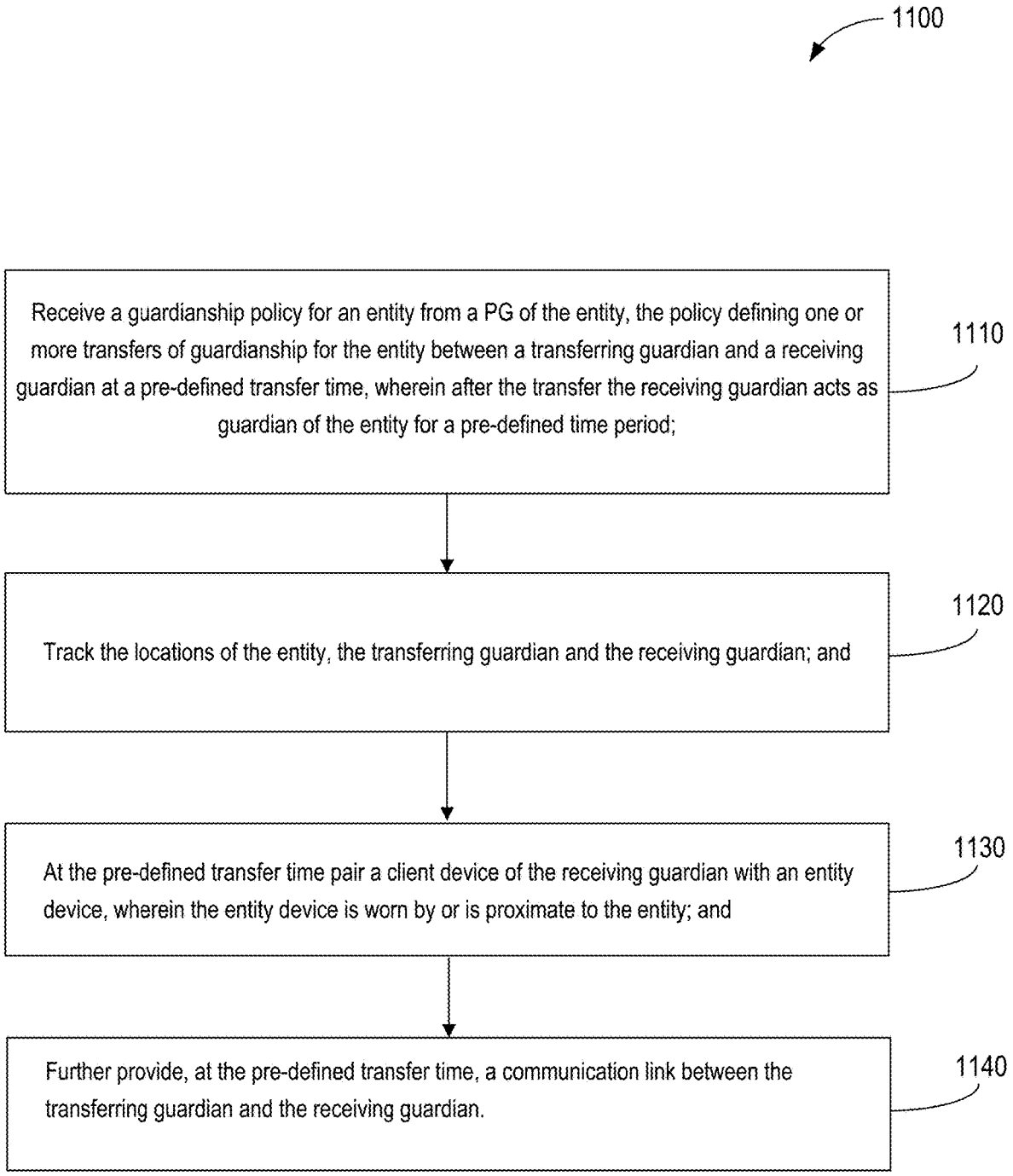
FIG. 11 illustrates an overview of the operational flow of a process for receiving a guardianship policy from a primary guardian of an entity, the policy defining one or more transfers of guardianship for the entity at a pre-defined transfer time, tracking the locations of the entity, the transferring guardian and the receiving guardian, and managing the transfer, in accordance with various embodiments.

Referring now to FIG. 11, an overview of the operational flow of a process for receiving a guardianship policy from a primary guardian of an entity, where the policy defines one or more transfers of guardianship for the entity at a pre-defined transfer time, tracking the locations of the entity, the transferring guardian and the receiving guardian, and managing the transfer, in accordance with various embodiments, is presented. Process 1100 may be performed by a CPU or processor, such as processor 1202 of FIG. 12, or cloudlet 120 as shown in FIG. 1, in accordance with various embodiments. Process 1100 may include blocks 1110 through 1140. In alternate embodiments, process 1100 may have more or less operations, and some of the operations may be performed in different order.

With reference to FIG. 11, process 1100 begins at block 1110, where a guardianship policy is received from a primary guardian of an entity, the policy defining one or more transfers of guardianship for the entity between a transferring guardian and a receiving guardian at a pre-defined transfer time by e.g., a CPU or a cloudlet. The policy further provides that after the transfer the receiving guardian acts as guardian of the entity for a pre-defined time period. For example, the policy may be a policy that provides for any of the transfers depicted in the use case of FIG. 9, such as, for example, the transfer of guardianship between teacher and bus driver, at the end of the entity's school day, as illustrated in block 930 of FIG. 9.

From block 1110, process 1100 proceeds to block 1120, where the locations of the entity, the transferring guardian and the receiving guardian are tracked, such as, for example, by the CPU or a cloudlet.

From block 1120, process 1100 moves to block 1130, where, at the pre-defined transfer time, as provided in the policy, a client device of the receiving guardian is paired with an entity device, where the entity device is worn by, or is proximate to, the entity. For example, the entity device may be a wearable entity device 110 of FIG. 1, and may include sensors 112, one of which is a GPS sensor, as shown in FIG. 1.

From block 1130, process 1100 moves to block 1140, where, at the pre-defined transfer time, there is further provided a communication link between the transferring guardian and the receiving guardian, thus facilitating the transfer.

Referring now to FIG. 12, wherein a block diagram of a computer device suitable for practicing the present disclosure, in accordance with various embodiments, is illustrated. As shown, computer device 1200 may include one or more processors 1202, and system memory 1204. Each processor 1202 may include one or more processor cores, and hardware accelerator 1205. An example of hardware accelerator 1207 may include, but is not limited to, programmed field programmable gate arrays (FPGA). Processors 1202 may be provided on a cloudlet server, such as cloudlet 120 of FIG. 1. Processors 1202 may function as one or more of metadata extraction module 131, metadata stream module 150 and UAC module 155, all of cloudlet 120 of FIG. 1, as shown in FIG. 12 by metadata extraction 1211, metadata stream 1211 and UAC 1208, for example.

Computer device 1200 may also include system memory 1204. In embodiments, system memory 1204 may include any known volatile or non-volatile memory. Additionally, computer device 1200 may include mass storage device(s) 1206, input/output device interfaces 1208 (to interface with various input/output devices, such as, mouse, cursor control, display device (including touch sensitive screen), and so forth) and communication interfaces 1210 (such as network interface cards, modems and so forth). In embodiments, communication interfaces 1210 may support wired or wireless communication, including near field communication. The elements may be coupled to each other via system bus 1212, which may represent one or more buses. In the case of multiple buses, they may be bridged by one or more bus bridges (not shown).

In embodiments, system memory 1204 and mass storage device(s) 1217 may be employed to store a working copy and a permanent copy of the executable code of the programming instructions of an operating system, one or more applications, and/or various software implemented components of metadata extraction module 131, metadata stream module 150 and UAC module 155, all of cloudlet 120 of FIG. 1, collectively referred to as computational logic 1222. The programming instructions implementing computational logic 1222 may comprise assembler instructions supported by processor(s) 1202 or high-level languages, such as, for example, C, that can be compiled into such instructions. In embodiments, some of computing logic may be implemented in hardware accelerator 1205. In embodiments, part of computational logic 1222, e.g., a portion of the computational logic 1222 associated with the runtime environment of the compiler may be implemented in hardware accelerator 1205.

The permanent copy of the executable code of the programming instructions or the bit streams for configuring hardware accelerator 1205 may be placed into permanent mass storage device(s) 1206 and/or hardware accelerator 1205 in the factory, or in the field, through, for example, a distribution medium (not shown), such as a compact disc (CD), or through communication interfaces 1210 (from a distribution server (not shown)).

The number, capability and/or capacity of these elements 1202-1222 may vary, depending on the intended use of example computer device 1200, e.g., whether example computer device 1200 is a server, a PC, a workstation, and so forth. The constitutions of these elements 1210-1222 are otherwise known, and accordingly will not be further described.

Figure 13:
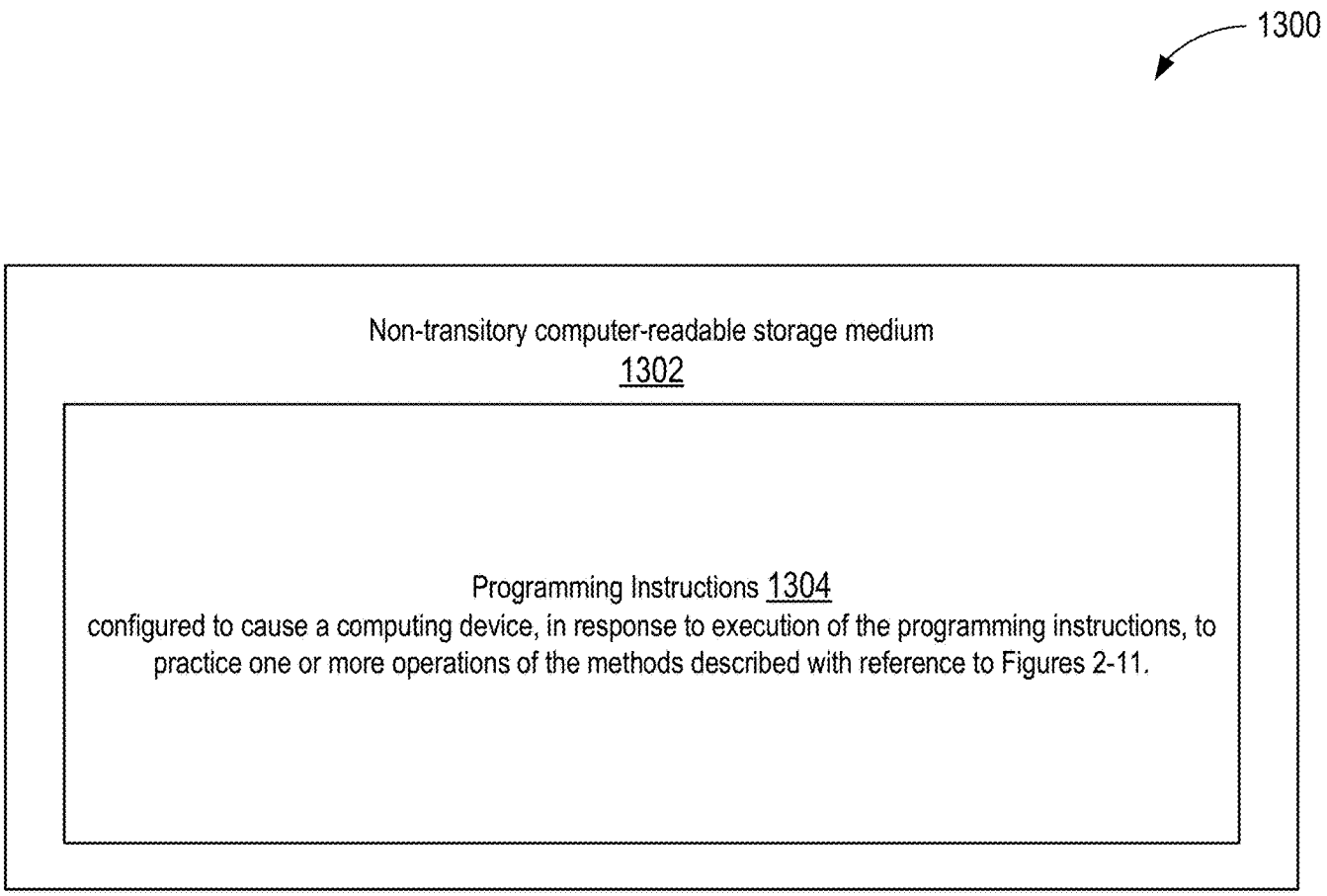
FIG. 13 illustrates an example computer-readable storage medium having instructions configured to practice aspects of the processes of FIGS. 2-11, in accordance with various embodiments.

Furthermore, the present disclosure may take the form of a computer program product or data to create the computer program, with the computer program or data embodied in any tangible or non-transitory medium of expression having the computer-usable program code (or data to create the computer program) embodied in the medium. FIG. 13 illustrates an example computer-readable non-transitory storage medium that may be suitable for use to store instructions (or data that creates the instructions) that cause an apparatus, in response to execution of the instructions by the apparatus, to practice selected aspects of the present disclosure, including, for example, to implement all (or portion of) software implementations of metadata extraction 131, messaging (metadata stream provision) 150, or user access control 155, all as shown in FIG. 1, and/or practice (aspects of) processes illustrated or shown in FIGS. 2-11, earlier described, in accordance with various embodiments. As shown, non-transitory computer-readable storage medium 1302 may include a number of programming instructions 1304 (or data to create the programming instructions). Programming instructions 1304 may be configured to enable a device, e.g., device 1200, in response to execution of the programming instructions, to perform, e.g., various programming operations associated with operating system functions, one or more applications, and/or aspects of the present disclosure. For example, executable code of programming instructions (or bit streams) 1304 may be configured to enable a device, e.g., computer device 1200, in response to execution of the executable code/programming instructions (or operation of an encoded hardware accelerator 1205), to perform (aspects of) processes performed by metadata extraction 131, messaging (metadata stream provision) 150, or user access control 155, all as shown in FIG. 1, and/or practice (aspects of) processes illustrated or shown in FIGS. 2-11.

In alternate embodiments, programming instructions 1304 (or data to create the instructions) may be disposed on multiple computer-readable non-transitory storage media 1302 instead. In alternate embodiments, programming instructions 1304 (or data to create the instructions) may be disposed on computer-readable transitory storage media 1302, such as, signals. Any combination of one or more computer usable or computer readable medium(s) may be utilized. The computer-usable or computer-readable medium may be, for example but not limited to, one or more electronic, magnetic, optical, electromagnetic, infrared, or semiconductor systems, apparatuses, devices, or propagation media. More specific examples (a non-exhaustive list) of a computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program (or data to create the program) is printed, as the program (or data to create the program) can be electronically captured, via, for instance, optical scanning of the paper or other medium, then compiled, interpreted, or otherwise processed in a suitable manner, if necessary, and then stored in a computer memory (with or without having been staged in or more intermediate storage media). In the context of this document, a computer-usable or computer-readable medium may be any medium that can contain, store, communicate, propagate, or transport the program (or data to create the program) for use by or in connection with the instruction execution system, apparatus, or device. The computer-usable medium may include a propagated data signal with the computer-usable program code (or data to create the program code) embodied therewith, either in baseband or as part of a carrier wave. The computer usable program code (or data to create the program) may be transmitted using any appropriate medium, including but not limited to wireless, wireline, optical fiber cable, RF, etc.

In various embodiments, the program code (or data to create the program code) described herein may be stored in one or more of a compressed format, an encrypted format, a fragmented format, a packaged format, etc. Program code (or data to create the program code) as described herein may require one or more of installation, modification, adaptation, updating, combining, supplementing, configuring, decryption, decompression, unpacking, distribution, reassignment, etc. in order to make them directly readable and/or executable by a computing device and/or other machine. For example, the program code (or data to create the program code) may be stored in multiple parts, which are individually compressed, encrypted, and stored on separate computing devices, wherein the parts when decrypted, decompressed, and combined form a set of executable instructions that implement the program code (the data to create the program code (such as that described herein. In another example, the Program code (or data to create the program code) may be stored in a state in which they may be read by a computer, but require addition of a library (e.g., a dynamic link library), a software development kit (SDK), an application programming interface (API), etc. in order to execute the instructions on a particular computing device or other device. In another example, the Program code (or data to create the program code) may need to be configured (e.g., settings stored, data input, network addresses recorded, etc.) before the program code (or data to create the program code) can be executed/used in whole or in part. Thus, the disclosed Program code (or data to create the program code) are intended to encompass such machine readable instructions and/or program(s) (or data to create such machine readable instruction and/or programs) regardless of the particular format or state of the machine readable instructions and/or program(s) when stored or otherwise at rest or in transit.

Computer program code for carrying out operations of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Referring back to FIG. 12, for one embodiment, at least one of processors 1202 may be packaged together with a computer-readable storage medium having some or all of computing logic 1222 (in lieu of storing in system memory 1204 and/or mass storage device 1206) configured to practice all or selected ones of the operations earlier described with reference to FIGS. 2-11. For one embodiment, at least one of processors 1202 may be packaged together with a computer-readable storage medium having some or all of computing logic 1222 to form a System in Package (SiP). For one embodiment, at least one of processors 1202 may be integrated on the same die with a computer-readable storage medium having some or all of computing logic 1222. For one embodiment, at least one of processors 1202 may be packaged together with a computer-readable storage medium having some or all of computing logic 1222 to form a System on Chip (SoC). For at least one embodiment, the SoC may be utilized in, e.g., but not limited to, a hybrid computing tablet/laptop.

Figure 14:
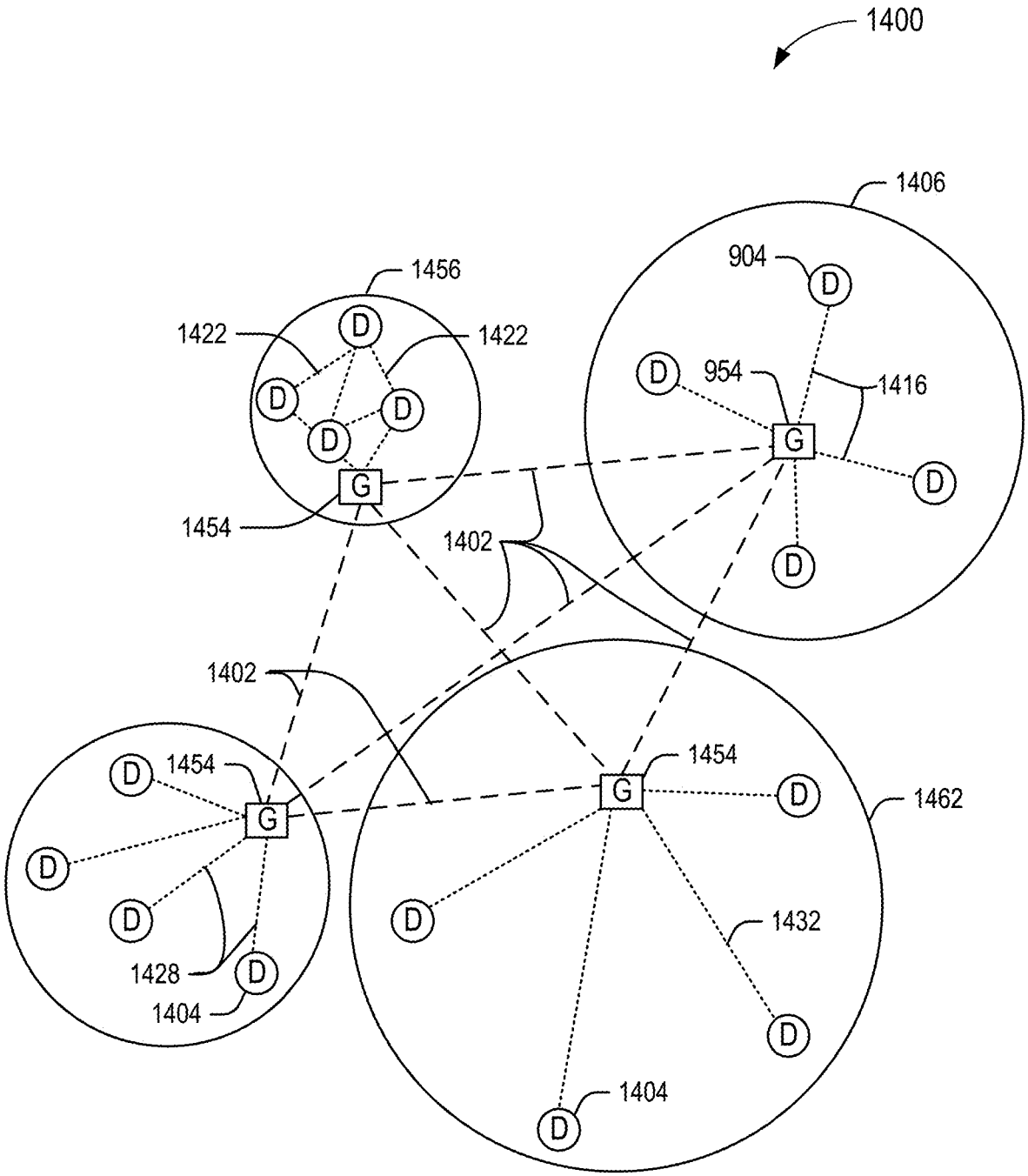
FIG. 14 illustrates an domain topology for respective internet-of-things (IoT) networks coupled through links to respective gateways, according to an example.

FIG. 14 illustrates an example domain topology for respective internet-of-things (IoT) networks coupled through links to respective gateways. The internet of things (IoT) is a concept in which a large number of computing devices are interconnected to each other and to the Internet to provide functionality and data acquisition at very low levels. Thus, as used herein, an IoT device may include a semiautonomous device performing a function, such as sensing or control, among others, in communication with other IoT devices and a wider network, such as the Internet.

Often, IoT devices are limited in memory, size, or functionality, allowing larger numbers to be deployed for a similar cost to smaller numbers of larger devices. However, an IoT device may be a smart phone, laptop, tablet, or PC, or other larger device. Further, an IoT device may be a virtual device, such as an application on a smart phone or other computing device. IoT devices may include IoT gateways, used to couple IoT devices to other IoT devices and to cloud applications, for data storage, process control, and the like.

Networks of IoT devices may include commercial and home automation devices, such as water distribution systems, electric power distribution systems, pipeline control systems, plant control systems, light switches, thermostats, locks, cameras, alarms, motion sensors, and the like. The IoT devices may be accessible through remote computers, servers, and other systems, for example, to control systems or access data.

Figure 15:
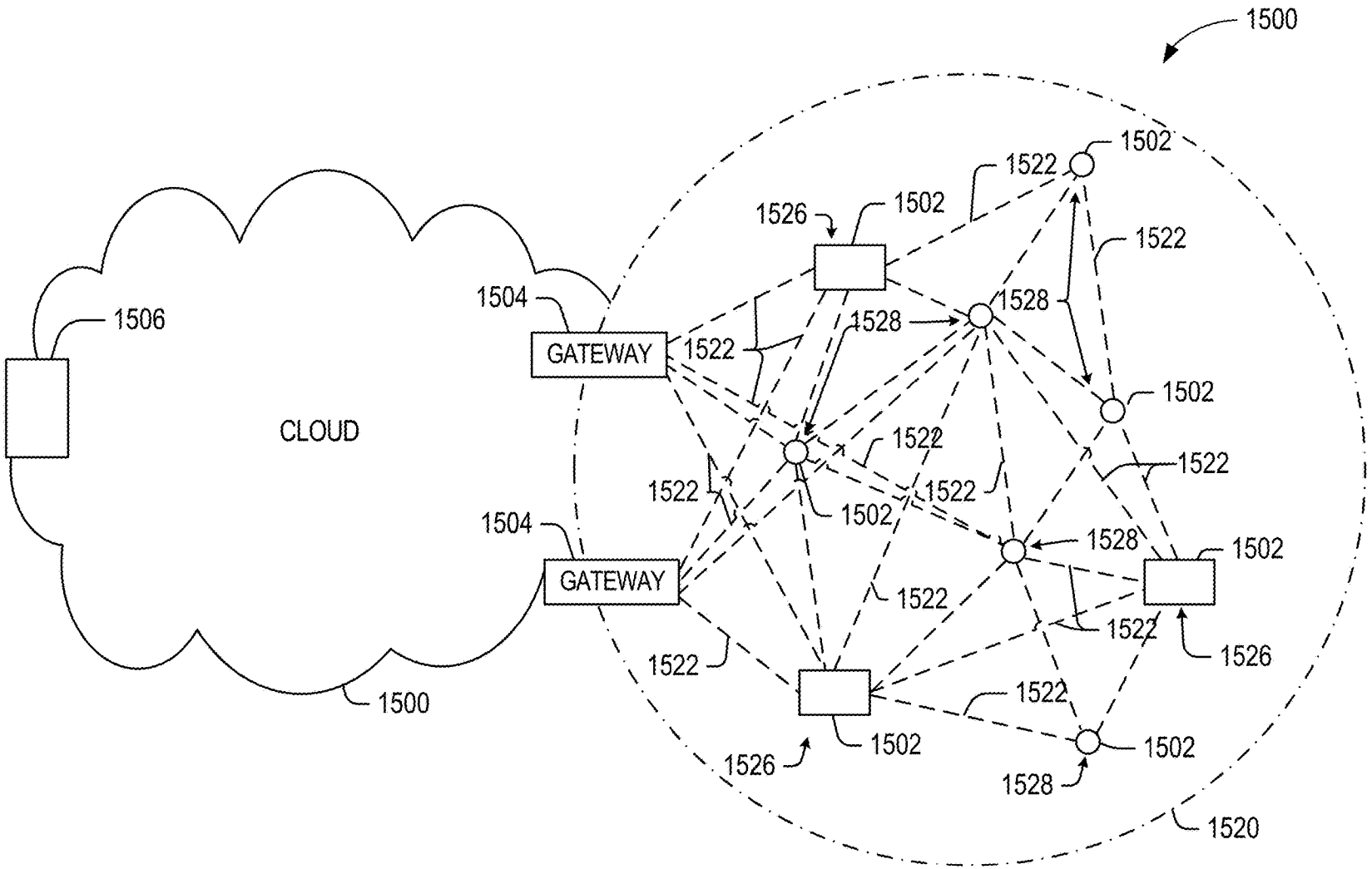
FIG. 15 illustrates a cloud computing network in communication with a mesh network of IoT devices operating as a fog device at the edge of the cloud computing network, according to an example.

The future growth of the Internet and like networks may involve very large numbers of IoT devices. Accordingly, in the context of the techniques discussed herein, a number of innovations for such future networking will address the need for all these layers to grow unhindered, to discover and make accessible connected resources, and to support the ability to hide and compartmentalize connected resources. Any number of network protocols and communications standards may be used, wherein each protocol and standard is designed to address specific objectives. Further, the protocols are part of the fabric supporting human accessible services that operate regardless of location, time or space. The innovations include service delivery and associated infrastructure, such as hardware and software; security enhancements; and the provision of services based on Quality of Service (QoS) terms specified in service level and service delivery agreements. As will be understood, the use of IoT devices and networks, such as those introduced in FIGS. 14 and 15, present a number of new challenges in a heterogeneous network of connectivity comprising a combination of wired and wireless technologies.

FIG. 14 specifically provides a simplified drawing of a domain topology that may be used for a number of internet-of-things (IoT) networks comprising IoT devices 1404, with the IoT networks 1456, 1458, 1460, 1462, coupled through backbone links 1402 to respective gateways 1454. For example, a number of IoT devices 1404 may communicate with a gateway 1454, and with each other through the gateway 1454. To simplify the drawing, not every IoT device 1404, or communications link (e.g., link 1416, 1422, 1428, or 1432) is labeled. The backbone links 1402 may include any number of wired or wireless technologies, including optical networks, and may be part of a local area network (LAN), a wide area network (WAN), or the Internet. Additionally, such communication links facilitate optical signal paths among both IoT devices 1404 and gateways 1454, including the use of MUXing/deMUXing components that facilitate interconnection of the various devices.

The network topology may include any number of types of IoT networks, such as a mesh network provided with the network 1456 using Bluetooth low energy (BLE) links 1422. Other types of IoT networks that may be present include a wireless local area network (WLAN) network 1458 used to communicate with IoT devices 1404 through IEEE 802.11 (Wi-Fi®) links 1428, a cellular network 1460 used to communicate with IoT devices 1404 through an LTE/LTE-A (4G) or 5G cellular network, and a low-power wide area (LPWA) network 1462, for example, a LPWA network compatible with the LoRaWan specification promulgated by the LoRa alliance, or a IPv6 over Low Power Wide-Area Networks (LPWAN) network compatible with a specification promulgated by the Internet Engineering Task Force (IETF). Further, the respective IoT networks may communicate with an outside network provider (e.g., a tier 2 or tier 3 provider) using any number of communications links, such as an LTE cellular link, an LPWA link, or a link based on the IEEE 802.15.4 standard, such as Zigbee®. The respective IoT networks may also operate with use of a variety of network and internet application protocols such as Constrained Application Protocol (CoAP). The respective IoT networks may also be integrated with coordinator devices that provide a chain of links that forms cluster tree of linked devices and networks.

Each of these IoT networks may provide opportunities for new technical features, such as those as described herein. The improved technologies and networks may enable the exponential growth of devices and networks, including the use of IoT networks into as fog devices or systems. As the use of such improved technologies grows, the IoT networks may be developed for self-management, functional evolution, and collaboration, without needing direct human intervention. The improved technologies may even enable IoT networks to function without centralized controlled systems. Accordingly, the improved technologies described herein may be used to automate and enhance network management and operation functions far beyond current implementations.

In an example, communications between IoT devices 1404, such as over the backbone links 1402, may be protected by a decentralized system for authentication, authorization, and accounting (AAA). In a decentralized AAA system, distributed payment, credit, audit, authorization, and authentication systems may be implemented across interconnected heterogeneous network infrastructure. This allows systems and networks to move towards autonomous operations. In these types of autonomous operations, machines may even contract for human resources and negotiate partnerships with other machine networks. This may allow the achievement of mutual objectives and balanced service delivery against outlined, planned service level agreements as well as achieve solutions that provide metering, measurements, traceability and trackability. The creation of new supply chain structures and methods may enable a multitude of services to be created, mined for value, and collapsed without any human involvement.

Such IoT networks may be further enhanced by the integration of sensing technologies, such as sound, light, electronic traffic, facial and pattern recognition, smell, vibration, into the autonomous organizations among the IoT devices. The integration of sensory systems may allow systematic and autonomous communication and coordination of service delivery against contractual service objectives, orchestration and quality of service (QoS) based swarming and fusion of resources. Some of the individual examples of network-based resource processing include the following.

The mesh network 1456, for instance, may be enhanced by systems that perform inline data-to-information transforms. For example, self-forming chains of processing resources comprising a multi-link network may distribute the transformation of raw data to information in an efficient manner, and the ability to differentiate between assets and resources and the associated management of each. Furthermore, the proper components of infrastructure and resource based trust and service indices may be inserted to improve the data integrity, quality, assurance and deliver a metric of data confidence.

The WLAN network 1458, for instance, may use systems that perform standards conversion to provide multi-standard connectivity, enabling IoT devices 1404 using different protocols to communicate. Further systems may provide seamless interconnectivity across a multi-standard infrastructure comprising visible Internet resources and hidden Internet resources.

Communications in the cellular network 1460, for instance, may be enhanced by systems that offload data, extend communications to more remote devices, or both. The LPWA network 1462 may include systems that perform non-Internet protocol (IP) to IP interconnections, addressing, and routing. Further, each of the IoT devices 1404 may include the appropriate transceiver for wide area communications with that device. Further, each IoT device 1404 may include other transceivers for communications using additional protocols and frequencies. This is discussed further with respect to the communication environment and hardware of an IoT processing device depicted in FIGS. 16 and 17.

Finally, clusters of IoT devices may be equipped to communicate with other IoT devices as well as with a cloud network. This may allow the IoT devices to form an ad-hoc network between the devices, allowing them to function as a single device, which may be termed a fog device. This configuration is discussed further with respect to FIG. 15 below.

FIG. 15 illustrates a cloud computing network in communication with a mesh network of IoT devices (devices 1502) operating as a fog device at the edge of the cloud computing network. The mesh network of IoT devices may be termed a fog 1520, operating at the edge of the cloud 1500. To simplify the diagram, not every IoT device 1502 is labeled.

The fog 1520 may be considered to be a massively interconnected network wherein a number of IoT devices 1502 are in communications with each other, for example, by radio links 1522. As an example, this interconnected network may be facilitated using an interconnect specification released by the Open Connectivity Foundation™ (OCF). This standard allows devices to discover each other and establish communications for interconnects. Other interconnection protocols may also be used, including, for example, the optimized link state routing (OLSR) Protocol, the better approach to mobile ad-hoc networking (B.A.T.M.A.N.) routing protocol, or the OMA Lightweight M2M (LWM2M) protocol, among others.

Three types of IoT devices 1502 are shown in this example, gateways 1504, data aggregators 1526, and sensors 1528, although any combinations of IoT devices 1502 and functionality may be used. The gateways 1504 may be edge devices that provide communications between the cloud 1500 and the fog 1520, and may also provide the backend process function for data obtained from sensors 1528, such as motion data, flow data, temperature data, and the like. The data aggregators 1526 may collect data from any number of the sensors 1528, and perform the back end processing function for the analysis. The results, raw data, or both may be passed along to the cloud 1500 through the gateways 1504. The sensors 1528 may be full IoT devices 1502, for example, capable of both collecting data and processing the data. In some cases, the sensors 1528 may be more limited in functionality, for example, collecting the data and allowing the data aggregators 1526 or gateways 1504 to process the data.

Communications from any IoT device 1502 may be passed along a convenient path (e.g., a most convenient path) between any of the IoT devices 1502 to reach the gateways 1504. In these networks, the number of interconnections provide substantial redundancy, allowing communications to be maintained, even with the loss of a number of IoT devices 1502. Further, the use of a mesh network may allow IoT devices 1502 that are very low power or located at a distance from infrastructure to be used, as the range to connect to another IoT device 1502 may be much less than the range to connect to the gateways 1504.

The fog 1520 provided from these IoT devices 1502 may be presented to devices in the cloud 1500, such as a server 1506, as a single device located at the edge of the cloud 1500, e.g., a fog device. In this example, the alerts coming from the fog device may be sent without being identified as coming from a specific IoT device 1502 within the fog 1520. In this fashion, the fog 1520 may be considered a distributed platform that provides computing and storage resources to perform processing or data-intensive tasks such as data analytics, data aggregation, and machine-learning, among others.

In some examples, the IoT devices 1502 may be configured using an imperative programming style, e.g., with each IoT device 1502 having a specific function and communication partners. However, the IoT devices 1502 forming the fog device may be configured in a declarative programming style, allowing the IoT devices 1502 to reconfigure their operations and communications, such as to determine needed resources in response to conditions, queries, and device failures. As an example, a query from a user located at a server 1506 about the operations of a subset of equipment monitored by the IoT devices 1502 may result in the fog 1520 device selecting the IoT devices 1502, such as particular sensors 1528, needed to answer the query. The data from these sensors 1528 may then be aggregated and analyzed by any combination of the sensors 1528, data aggregators 1526, or gateways 1504, before being sent on by the fog 1520 device to the server 1506 to answer the query. In this example, IoT devices 1502 in the fog 1520 may select the sensors 1528 used based on the query, such as adding data from flow sensors or temperature sensors. Further, if some of the IoT devices 1502 are not operational, other IoT devices 1502 in the fog 1520 device may provide analogous data, if available.

In other examples, the operations and functionality described above may be embodied by a IoT device machine in the example form of an electronic processing system, within which a set or sequence of instructions may be executed to cause the electronic processing system to perform any one of the methodologies discussed herein, according to an example embodiment. The machine may be an IoT device or an IoT gateway, including a machine embodied by aspects of a personal computer (PC), a tablet PC, a personal digital assistant (PDA), a mobile telephone or smartphone, or any machine capable of executing instructions (sequential or otherwise) that specify actions to be taken by that machine. Further, while only a single machine may be depicted and referenced in the example above, such machine shall also be taken to include any collection of machines that individually or jointly execute a set (or multiple sets) of instructions to perform any one or more of the methodologies discussed herein. Further, these and like examples to a processor-based system shall be taken to include any set of one or more machines that are controlled by or operated by a processor (e.g., a computer) to individually or jointly execute instructions to perform any one or more of the methodologies discussed herein.

Figure 16:
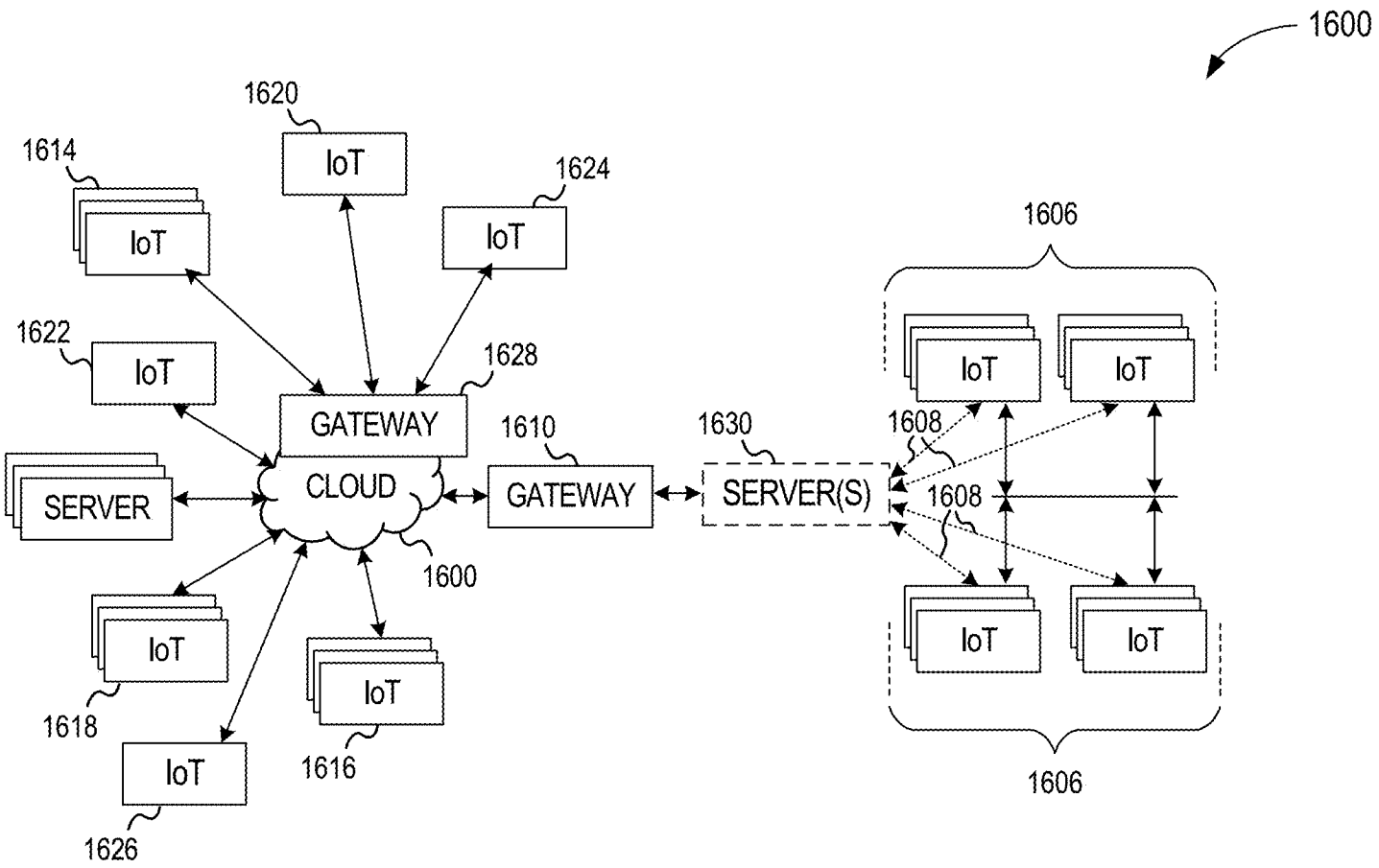
FIG. 16 illustrates a block diagram of a network illustrating communications among a number of IoT devices, according to an example.

FIG. 16 illustrates a drawing of a cloud computing network, or cloud 1600, in communication with a number of Internet of Things (IoT) devices. The cloud 1600 may represent the Internet, or may be a local area network (LAN), or a wide area network (WAN), such as a proprietary network for a company. The IoT devices may include any number of different types of devices, grouped in various combinations. For example, a traffic control group 1606 may include IoT devices along streets in a city. These IoT devices may include stoplights, traffic flow monitors, cameras, weather sensors, and the like. The traffic control group 1606, or other subgroups, may be in communication with the cloud 1600 through wired or wireless links 1608, such as LPWA links, optical links, and the like. Further, a wired or wireless sub-network 1612 may allow the IoT devices to communicate with each other, such as through a local area network, a wireless local area network, and the like. The IoT devices may use another device, such as a gateway 1610 or 1628 to communicate with remote locations such as the cloud 1600; the IoT devices may also use one or more servers 1630 to facilitate communication with the cloud 1600 or with the gateway 1610. For example, the one or more servers 1630 may operate as an intermediate network node to support a local edge cloud or fog implementation among a local area network. Further, the gateway 1628 that is depicted may operate in a cloud-to-gateway-to-many edge devices configuration, such as with the various IoT devices 1614, 1620, 1624 being constrained or dynamic to an assignment and use of resources in the cloud 1600.

Other example groups of IoT devices may include remote weather stations 1614, local information terminals 1616, alarm systems 1618, automated teller machines 1620, alarm panels 1622, or moving vehicles, such as emergency vehicles 1624 or other vehicles 1626, among many others. Each of these IoT devices may be in communication with other IoT devices, with servers 1604, with another IoT fog device or system (not shown, but depicted in FIG. 15), or a combination therein. The groups of IoT devices may be deployed in various residential, commercial, and industrial settings (including in both private or public environments).

As can be seen from FIG. 16, a large number of IoT devices may be communicating through the cloud 1600. This may allow different IoT devices to request or provide information to other devices autonomously. For example, a group of IoT devices (e.g., the traffic control group 1606) may request a current weather forecast from a group of remote weather stations 1614, which may provide the forecast without human intervention. Further, an emergency vehicle 1624 may be alerted by an automated teller machine 1620 that a burglary is in progress. As the emergency vehicle 1624 proceeds towards the automated teller machine 1620, it may access the traffic control group 1606 to request clearance to the location, for example, by lights turning red to block cross traffic at an intersection in sufficient time for the emergency vehicle 1624 to have unimpeded access to the intersection.

Clusters of IoT devices, such as the remote weather stations 1614 or the traffic control group 1606, may be equipped to communicate with other IoT devices as well as with the cloud 1600. This may allow the IoT devices to form an ad-hoc network between the devices, allowing them to function as a single device, which may be termed a fog device or system (e.g., as described above with reference to FIG. 15).

Figure 17:
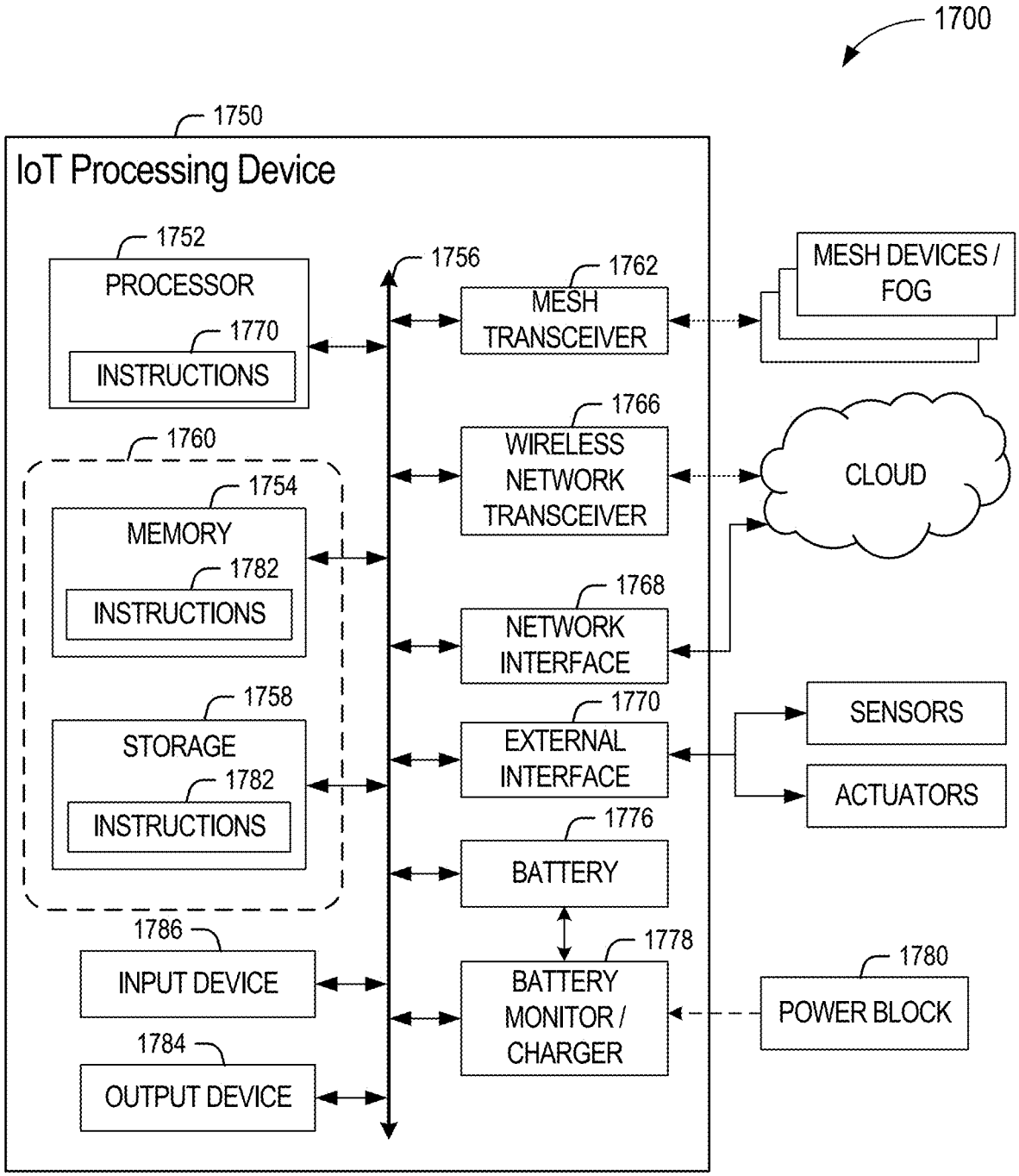
FIG. 17 illustrates a block diagram for an example IoT processing system architecture upon which any one or more of the techniques (e.g., operations, processes, methods, and methodologies) discussed herein may be performed, according to an example.

FIG. 17 is a block diagram of an example of components that may be present in an IoT device 1750 for implementing the techniques described herein. The IoT device 1750 may include any combinations of the components shown in the example or referenced in the disclosure above. The components may be implemented as ICs, portions thereof, discrete electronic devices, or other modules, logic, hardware, software, firmware, or a combination thereof adapted in the IoT device 1750, or as components otherwise incorporated within a chassis of a larger system. Additionally, the block diagram of FIG. 17 is intended to depict a high-level view of components of the IoT device 1750. However, some of the components shown may be omitted, additional components may be present, and different arrangement of the components shown may occur in other implementations.

The IoT device 1750 may include a processor 1752, which may be a microprocessor, a multi-core processor, a multithreaded processor, an ultra-low voltage processor, an embedded processor, or other known processing element. The processor 1752 may be a part of a system on a chip (SoC) in which the processor 1752 and other components are formed into a single integrated circuit, or a single package, such as the Edison™ or Galileo™ SoC boards from Intel. As an example, the processor 1752 may include an Intel® Architecture Core™ based processor, such as a Quark™, an Atom™, an i3, an i5, an i7, or an MCU-class processor, or another such processor available from Intel® Corporation, Santa Clara, Calif. However, any number other processors may be used, such as available from Advanced Micro Devices, Inc. (AMD) of Sunnyvale, Calif., a MIPS-based design from MIPS Technologies, Inc. of Sunnyvale, Calif., an ARM-based design licensed from ARM Holdings, Ltd. or customer thereof, or their licensees or adopters. The processors may include units such as an A5-A10 processor from Apple® Inc., a Snapdragon™ processor from Qualcomm® Technologies, Inc., or an OMAP™ processor from Texas Instruments, Inc.

The processor 1752 may communicate with a system memory 1754 over an interconnect 1756 (e.g., a bus). Any number of memory devices may be used to provide for a given amount of system memory. As examples, the memory may be random access memory (RAM) in accordance with a Joint Electron Devices Engineering Council (JEDEC) design such as the DDR or mobile DDR standards (e.g., LPDDR, LPDDR2, LPDDR3, or LPDDR4). In various implementations the individual memory devices may be of any number of different package types such as single die package (SDP), dual die package (DDP) or quad die package (Q17P). These devices, in some examples, may be directly soldered onto a motherboard to provide a lower profile solution, while in other examples the devices are configured as one or more memory modules that in turn couple to the motherboard by a given connector. Any number of other memory implementations may be used, such as other types of memory modules, e.g., dual inline memory modules (DIMMs) of different varieties including but not limited to microDIMMs or MiniDIMMs.

To provide for persistent storage of information such as data, applications, operating systems and so forth, a storage 1758 may also couple to the processor 1752 via the interconnect 1756. In an example the storage 1758 may be implemented via a solid state disk drive (SSDD). Other devices that may be used for the storage 1758 include flash memory cards, such as SD cards, microSD cards, xD picture cards, and the like, and USB flash drives. In low power implementations, the storage 1758 may be on-die memory or registers associated with the processor 1752. However, in some examples, the storage 1758 may be implemented using a micro hard disk drive (HDD). Further, any number of new technologies may be used for the storage 1758 in addition to, or instead of, the technologies described, such resistance change memories, phase change memories, holographic memories, or chemical memories, among others.

The components may communicate over the interconnect 1756. The interconnect 1756 may include any number of technologies, including industry standard architecture (ISA), extended ISA (EISA), peripheral component interconnect (PCI), peripheral component interconnect extended (PCIx), PCI express (PCIe), or any number of other technologies. The interconnect 1756 may be a proprietary bus, for example, used in a SoC based system. Other bus systems may be included, such as an I2C interface, an SPI interface, point to point interfaces, and a power bus, among others.

The interconnect 1756 may couple the processor 1752 to a mesh transceiver 1762, for communications with other mesh devices 1764. The mesh transceiver 1762 may use any number of frequencies and protocols, such as 2.4 Gigahertz (GHz) transmissions under the IEEE 802.15.4 standard, using the Bluetooth® low energy (BLE) standard, as defined by the Bluetooth® Special Interest Group, or the ZigBee® standard, among others. Any number of radios, configured for a particular wireless communication protocol, may be used for the connections to the mesh devices 1764. For example, a WLAN unit may be used to implement Wi-Fi™ communications in accordance with the Institute of Electrical and Electronics Engineers (IEEE) 802.11 standard. In addition, wireless wide area communications, e.g., according to a cellular or other wireless wide area protocol, may occur via a WWAN unit.

The mesh transceiver 1762 may communicate using multiple standards or radios for communications at different range. For example, the IoT device 1750 may communicate with close devices, e.g., within about 10 meters, using a local transceiver based on BLE, or another low power radio, to save power. More distant mesh devices 1764, e.g., within about 50 meters, may be reached over ZigBee or other intermediate power radios. Both communications techniques may take place over a single radio at different power levels, or may take place over separate transceivers, for example, a local transceiver using BLE and a separate mesh transceiver using ZigBee.

A wireless network transceiver 1766 may be included to communicate with devices or services in the cloud 1700 via local or wide area network protocols. The wireless network transceiver 1766 may be a LPWA transceiver that follows the IEEE 802.15.4, or IEEE 802.15.4g standards, among others. The IoT device 1750 may communicate over a wide area using LoRaWAN™ (Long Range Wide Area Network) developed by Semtech and the LoRa Alliance. The techniques described herein are not limited to these technologies, but may be used with any number of other cloud transceivers that implement long range, low bandwidth communications, such as Sigfox, and other technologies. Further, other communications techniques, such as time-slotted channel hopping, described in the IEEE 802.15.4e specification may be used.

Any number of other radio communications and protocols may be used in addition to the systems mentioned for the mesh transceiver 1762 and wireless network transceiver 1766, as described herein. For example, the radio transceivers 1762 and 1766 may include an LTE or other cellular transceiver that uses spread spectrum (SPA/SAS) communications for implementing high speed communications. Further, any number of other protocols may be used, such as Wi-Fi® networks for medium speed communications and provision of network communications.

The radio transceivers 1762 and 1766 may include radios that are compatible with any number of 3GPP (Third Generation Partnership Project) specifications, notably Long Term Evolution (LTE), Long Term Evolution-Advanced (LTE-A), and Long Term Evolution-Advanced Pro (LTE-A Pro). It can be noted that radios compatible with any number of other fixed, mobile, or satellite communication technologies and standards may be selected. These may include, for example, any Cellular Wide Area radio communication technology, which may include e.g. a 5th Generation (5G) communication systems, a Global System for Mobile Communications (GSM) radio communication technology, a General Packet Radio Service (GPRS) radio communication technology, or an Enhanced Data Rates for GSM Evolution (EDGE) radio communication technology, a UMTS (Universal Mobile Telecommunications System) communication technology, In addition to the standards listed above, any number of satellite uplink technologies may be used for the wireless network transceiver 1766, including, for example, radios compliant with standards issued by the ITU (International Telecommunication Union), or the ETSI (European Telecommunications Standards Institute), among others. The examples provided herein are thus understood as being applicable to various other communication technologies, both existing and not yet formulated.

A network interface controller (NIC) 1768 may be included to provide a wired communication to the cloud 1700 or to other devices, such as the mesh devices 1764. The wired communication may provide an Ethernet connection, or may be based on other types of networks, such as Controller Area Network (CAN), Local Interconnect Network (LIN), DeviceNet, ControlNet, Data Highway+, PROFIBUS, or PROFINET, among many others. An additional MC 1768 may be included to allow connect to a second network, for example, a NIC 1768 providing communications to the cloud over Ethernet, and a second NIC 1768 providing communications to other devices over another type of network.

The interconnect 1756 may couple the processor 1752 to an external interface 1770 that is used to connect external devices or subsystems. The external devices may include sensors 1772, such as accelerometers, level sensors, flow sensors, optical light sensors, camera sensors, temperature sensors, a global positioning system (GPS) sensors, pressure sensors, barometric pressure sensors, and the like. The external interface 1770 further may be used to connect the IoT device 1750 to actuators 1774, such as power switches, valve actuators, an audible sound generator, a visual warning device, and the like.

In some optional examples, various input/output (I/O) devices may be present within, or connected to, the IoT device 1750. For example, a display or other output device 1784 may be included to show information, such as sensor readings or actuator position. An input device 1786, such as a touch screen or keypad may be included to accept input. An output device 1784 may include any number of forms of audio or visual display, including simple visual outputs such as binary status indicators (e.g., LEDs) and multi-character visual outputs, or more complex outputs such as display screens (e.g., LCD screens), with the output of characters, graphics, multimedia objects, and the like being generated or produced from the operation of the IoT device 1750.

A battery 1776 may power the IoT device 1750, although in examples in which the IoT device 1750 is mounted in a fixed location, it may have a power supply coupled to an electrical grid. The battery 1776 may be a lithium ion battery, or a metal-air battery, such as a zinc-air battery, an aluminum-air battery, a lithium-air battery, and the like.

A battery monitor/charger 1778 may be included in the IoT device 1750 to track the state of charge (SoCh) of the battery 1776. The battery monitor/charger 1778 may be used to monitor other parameters of the battery 1776 to provide failure predictions, such as the state of health (SoH) and the state of function (SoF) of the battery 1776. The battery monitor/charger 1778 may include a battery monitoring integrated circuit, such as an LTC4020 or an LTC2990 from Linear Technologies, an ADT7488A from ON Semiconductor of Phoenix Ariz., or an IC from the UCD90xxx family from Texas Instruments of Dallas, Tex. The battery monitor/charger 1778 may communicate the information on the battery 1776 to the processor 1752 over the interconnect 1756. The battery monitor/charger 1778 may also include an analog-to-digital (ADC) convertor that allows the processor 1752 to directly monitor the voltage of the battery 1776 or the current flow from the battery 1776. The battery parameters may be used to determine actions that the IoT device 1750 may perform, such as transmission frequency, mesh network operation, sensing frequency, and the like.

A power block 1780, or other power supply coupled to a grid, may be coupled with the battery monitor/charger 1778 to charge the battery 1776. In some examples, the power block 1780 may be replaced with a wireless power receiver to obtain the power wirelessly, for example, through a loop antenna in the IoT device 1750. A wireless battery charging circuit, such as an LTC4020 chip from Linear Technologies of Milpitas, Calif., among others, may be included in the battery monitor/charger 1778. The specific charging circuits chosen depend on the size of the battery 1776, and thus, the current required. The charging may be performed using the Airfuel standard promulgated by the Airfuel Alliance, the Qi wireless charging standard promulgated by the Wireless Power Consortium, or the Rezence charging standard, promulgated by the Alliance for Wireless Power, among others.

The storage 1758 may include instructions 1782 in the form of software, firmware, or hardware commands to implement the techniques described herein. Although such instructions 1782 are shown as code blocks included in the memory 1754 and the storage 1758, it may be understood that any of the code blocks may be replaced with hardwired circuits, for example, built into an application specific integrated circuit (ASIC).

In an example, the instructions 1782 provided via the memory 1754, the storage 1758, or the processor 1752 may be embodied as a non-transitory, machine readable medium 1760 including code to direct the processor 1752 to perform electronic operations in the IoT device 1750. The processor 1752 may access the non-transitory, machine readable medium 1760 over the interconnect 1756. For instance, the non-transitory, machine readable medium 1760 may be embodied by devices described for the storage 1758 of FIG. 16 or may include specific storage units such as optical disks, flash drives, or any number of other hardware devices. The non-transitory, machine readable medium 1760 may include instructions to direct the processor 1752 to perform a specific sequence or flow of actions, for example, as described with respect to the flowchart(s) and block diagram (s) of operations and functionality depicted above.

In further examples, a machine-readable medium also includes any tangible medium that is capable of storing, encoding or carrying instructions for execution by a machine and that cause the machine to perform any one or more of the methodologies of the present disclosure or that is capable of storing, encoding or carrying data structures utilized by or associated with such instructions. A "machine-readable medium" thus may include, but is not limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks. The instructions embodied by a machine-readable medium may further be transmitted or received over a communications network using a transmission medium via a network interface device utilizing any one of a number of transfer protocols (e.g., HTTP).

It should be understood that the functional units or capabilities described in this specification may have been referred to or labeled as components or modules, in order to more particularly emphasize their implementation independence. Such components may be embodied by any number of software or hardware forms. For example, a component or module may be implemented as a hardware circuit comprising custom very-large-scale integration (VLSI) circuits or gate arrays, off-the-shelf semiconductors such as logic chips, transistors, or other discrete components. A component or module may also be implemented in programmable hardware devices such as field programmable gate arrays, programmable array logic, programmable logic devices, or the like. Components or modules may also be implemented in software for execution by various types of processors. An identified component or module of executable code may, for instance, comprise one or more physical or logical blocks of computer instructions, which may, for instance, be organized as an object, procedure, or function. Nevertheless, the executables of an identified component or module need not be physically located together, but may comprise disparate instructions stored in different locations which, when joined logically together, comprise the component or module and achieve the stated purpose for the component or module.

Indeed, a component or module of executable code may be a single instruction, or many instructions, and may even be distributed over several different code segments, among different programs, and across several memory devices or processing systems. In particular, some aspects of the described process (such as code rewriting and code analysis) may take place on a different processing system (e.g., in a computer in a data center), than that in which the code is deployed (e.g., in a computer embedded in a sensor or robot). Similarly, operational data may be identified and illustrated herein within components or modules, and may be embodied in any suitable form and organized within any suitable type of data structure. The operational data may be collected as a single data set, or may be distributed over different locations including over different storage devices, and may exist, at least partially, merely as electronic signals on a system or network. The components or modules may be passive or active, including agents operable to perform desired functions.

Illustrative examples of the technologies disclosed herein are provided below. An embodiment of the technologies may include any one or more, and any combination of, the examples described below.

EXAMPLES

Example 1 includes one or more non-transitory computer-readable storage media comprising a set of instructions, which, when executed on a processor of a server, causes the server to: receive sensor data from at least one sensor proximate to an entity, wherein the entity is a human under care of at least one temporary guardian (TG) pursuant to a set of guardianship rules, the guardianship rules including a pre-defined geographic boundary in which the entity is to remain while under the care of the at least one TG; extract location metadata of the entity from the sensor data; and based at least in part on the metadata, send notifications to the TG and to a primary guardian (PG) of the entity when the entity is outside of the pre-defined boundary.

Example 2 includes the one or more non-transitory computer-readable storage media of example 1, and/or any other example herein, wherein the server is further caused to receive the set of guardianship rules from the PG prior to a commencement of the temporary guardianship.

Example 3 includes the one or more non-transitory computer-readable storage media of example 2, and/or any other example herein, wherein the set of guardianship rules is specific to an individual TG, or to a type of TG.

Example 4 includes the one or more non-transitory computer-readable storage media of example 3, and/or any other example herein, wherein the entity is a school-age child, and the type of TG covered by the guardianship rules includes at least one of principal, teacher, teacher's aide, babysitter or bus driver.

Example 5 includes the one or more non-transitory computer-readable storage media of example 1, and/or any other example herein, wherein the pre-defined boundary is elastic, and includes a specified distance from one or more TGs, and further comprising instructions that, when executed, cause the processor to: track the location of the one or more TGs; and calculate the distance between the one or more TGs and the entity.

Example 6 includes the one or more non-transitory computer-readable storage media of example 5, and/or any other example herein, wherein the one or more TGs includes a first TG and a second TG, the first TG to primarily supervise the entity, and the second TG a supervisor of the first TG, and wherein the pre-defined boundary includes a specified first distance from the first TG and a specified second distance from the second TG.

Example 7 includes the one or more non-transitory computer-readable storage media of example 6, and/or any other example herein, wherein the second distance is greater than the first distance.

Example 8 includes the one or more non-transitory computer-readable storage media of example 6, and/or any other example herein, wherein the first TG is a teacher at a school attended by the entity, and the second TG is a principal of the school.

Example 9 includes the one or more non-transitory computer-readable storage media of example 1, and/or any other example herein, wherein the at least one TG includes one or more nurses working in a hospital newborn ward, the entity includes a newborn baby, and the predefined geographic boundary is either a distance from the hospital newborn ward, or the walls of the hospital.

Example 10 includes one or more non-transitory computer-readable storage media comprising a set of instructions, which, when executed on a processor of a cloudlet, causes the cloudlet to: receive a guardianship policy for an entity from a PG of the entity, the policy defining one or more transfers of guardianship for the entity between a transferring guardian and a receiving guardian at a pre-defined transfer time, wherein after the transfer the receiving guardian acts as guardian of the entity for a pre-defined time period; track the locations of the entity, the transferring guardian and the receiving guardian; and at the pre-defined transfer time: pair a client device of the receiving guardian with an entity device, wherein the entity device is worn by or is proximate to the entity; and provide a communication link between the transferring guardian and the receiving guardian.

Example 11 includes the one or more non-transitory computer-readable storage media of example 10, and/or any other example herein, wherein the cloudlet is further caused to: determine that a transfer of guardianship has occurred; disconnect the entity device from the transferring guardian, if the transferring guardian is a TG.

Example 12 includes the one or more non-transitory computer-readable storage media of example 10, and/or any other example herein, further comprising instructions that, when executed, cause the processor to: determine that the entity has not been transferred to a receiving guardian at the pre-defined transfer time; and send an alert to the PG that a scheduled transfer of guardianship has not occurred.

Example 13 includes the one or more non-transitory computer-readable storage media of example 10, and/or any other example herein, further comprising instructions that, when executed, cause the processor to: receive notification from a transferring guardian that an upcoming transfer cannot occur as scheduled; forward the notification to the PG; receive, from the PG, a revised transfer time for the upcoming transfer; and update the policy with the revised transfer time.

Example 14 includes the one or more non-transitory computer-readable storage media of example 13, and/or any other example herein, further comprising instructions that, when executed, cause the processor to: provide a communication link between the transferring guardian and the PG to allow the PG to verify why the upcoming transfer cannot occur as scheduled and a likely time when the transfer can occur.

Example 15 includes the one or more non-transitory computer-readable storage media of example 10, and/or any other example herein, wherein the policy further defines a virtual fence for the entity to be applied during each pre-defined time period.

Example 16 includes the one or more non-transitory computer-readable storage media of example 13, and/or any other example herein, further comprising instructions that, when executed, cause the processor to: determine that a suspicious situation has occurred regarding the entity device; and alert the PG that the suspicious situation has occurred.

Example 17 is an apparatus, comprising: an input interface to receive a sensor data stream from a set of sensors proximate to an entity, wherein the entity is under care of at least one temporary guardian (TG) pursuant to a policy, the policy rules including pre-defined restrictions on at least one of: interactions between the entity and other entities under care of the TG or another TG, or activities the entity may engage in or foods the entity may eat while under the care of the TG; an output interface; an analyzer, coupled to the input interface and to the output interface, to: extract metadata from the sensor data stream, the metadata including behavior detection and activity recognition of the entity; and based at least in part on the metadata, send notifications, via the output interface, to the TG and to a permanent guardian (PG) of the entity when the pre-defined restrictions are violated.

Example 18 includes the apparatus of example 17, and/or any other example herein, wherein at least one of: the set of sensors include one or more of a camera, a global positioning system (GPS) sensor or a Bluetooth low energy sensor, or the set of sensors is one of wearable by the entity, embedded in the entity, or provided in a computing device carried by the entity or in which the entity is carried or transported.

Example 19 includes the apparatus of claim 17, the analyzer further to: receive, via the input interface, location data from the at least one TG, and virtually connect the entity to the at least one TG.

Example 20 includes the apparatus of example 17, and/or any other example herein, wherein the input interface is further to receive the policy, and wherein the pre-defined restrictions include at least one of: the entity refraining from play with one or more pre-defined other entities also under the care of the TG, preventing the entity from consuming a pre-defined set of foods, or refraining from engaging in a pre-defined set of athletic activities.

Example 21 includes the apparatus of example 20, and/or any other example herein, wherein the analyzer is further to send to the TG and to the PG a directive for curative action in response to the violation of the restriction.

Example 22 includes the apparatus of example 17, and/or any other example herein, wherein the entity is one of a child of the PG, an elderly relative of the PG or a newborn baby of the PG, and wherein the policy rules include default restrictions for all similar entities that are modifiable in part by the PG or the TG, or both.

Example 23 is a method, comprising: receiving a policy regarding care of an entity; receiving a directive of delegation of guardianship from a PG of the entity to a TG of the entity, the directive indicating that the TG is to care for the entity during a pre-defined time; configuring terms of the guardianship by the TG based on the policy; communicating the terms of the guardianship to the TG; tracking the entity and the TG during the pre-defined time, in which, at least in part, the entity is mobile; and virtually tying the entity to the TG during the pre-defined time to control the location of the entity.

Example 24 includes the method of example 23, and/or any other example herein, further comprising creating an elastic boundary within which the entity is to be contained during the guardianship, the elastic boundary defined, at least in part, in terms of proximity to the TG.

Example 25 includes the method of example 23, and/or any other example herein, wherein the TG is a first TG, and the pre-defined time is a first pre-defined time, and further comprising: receiving a directive of delegation of guardianship from the first TG to a second TG, the delegation providing that the second TG is to care for the entity during a second pre-defined time; configuring terms of the guardianship by the second TG based on the policy; communicating the terms of the guardianship to the second TG; tracking the entity and the second TG during the second pre-defined time, in which, at least in part, the entity is mobile; and virtually tying the entity to the second TG during the second pre-defined time to control the location of the entity.

Example 26 is an apparatus for computing, comprising: means for receiving sensor data from at least one sensor proximate to an entity, wherein the entity is a human under care of at least one temporary guardian (TG) pursuant to a set of guardianship rules, the guardianship rules including a pre-defined geographic boundary in which the entity is to remain while under the care of the at least one TG; means for extracting location metadata of the entity from the sensor data; and means for sending notifications to the TG and to a primary guardian (PG) of the entity when the entity is outside of the pre-defined boundary, based at least in part on the metadata.

Example 27 is the apparatus for computing of example 26, and/or any other example herein, further comprising means for receiving the set of guardianship rules from the PG prior to a commencement of the temporary guardianship.

Example 28 is the apparatus for computing of example 27, and/or any other example herein, wherein the set of guardianship rules is specific to an individual TG, or to a type of TG.

Example 29 is the apparatus for computing of example 28, and/or any other example herein, wherein the entity is a school-age child, and the type of TG covered by the guardianship rules includes at least one of principal, teacher, teacher's aide, babysitter or bus driver.

Example 30 is the apparatus for computing of example 26, and/or any other example herein, wherein the pre-defined boundary is elastic, and includes a specified distance from one or more TGs, and further comprising: means for tracking the location of the one or more TGs; and means for calculating the distance between the one or more TGs and the entity.

Example 31 is the apparatus for computing of example 30, and/or any other example herein, wherein the one or more TGs includes a first TG and a second TG, the first TG to primarily supervise the entity, and the second TG a supervisor of the first TG, and wherein the pre-defined boundary includes a specified first distance from the first TG and a specified second distance from the second TG.

Example 32 is the apparatus for computing of example 31, and/or any other example herein, wherein the second distance is greater than the first distance.

Example 33 is the apparatus for computing of example 31, and/or any other example herein, wherein the first TG is a teacher at a school attended by the entity, and the second TG is a principal of the school.

Example 34 is the apparatus for computing of example 26, and/or any other example herein, wherein the at least one TG includes one or more nurses working in a hospital newborn ward, the entity includes a newborn baby, and the predefined geographic boundary is either a distance from the hospital newborn ward, or the walls of the hospital.

Example 35 is an apparatus for computing, comprising: means for receiving a guardianship policy for an entity from a PG of the entity, the policy defining one or more transfers of guardianship for the entity between a transferring guardian and a receiving guardian at a pre-defined transfer time, wherein after the transfer the receiving guardian acts as guardian of the entity for a pre-defined time period; means for tracking the locations of the entity, the transferring guardian and the receiving guardian; means for pairing, at the pre-defined transfer time, a client device of the receiving guardian with an entity device, wherein the entity device is worn by or is proximate to the entity; and means for providing a communication link between the transferring guardian and the receiving guardian, at the pre-defined transfer time.

Example 36 includes the apparatus for computing of example 35, and/or any other example herein, further comprising means for determining that a transfer of guardianship has occurred, and means for disconnecting the entity device from the transferring guardian, if the transferring guardian is a TG.

Example 37 includes the apparatus for computing of example 35, and/or any other example herein, further comprising means for determining that the entity has not been transferred to a receiving guardian at the pre-defined transfer time; and send an alert to the PG that a scheduled transfer of guardianship has not occurred.

Example 38 includes the apparatus for computing of example 35, and/or any other example herein, further comprising: means for receiving notification from a transferring guardian that an upcoming transfer cannot occur as scheduled; means for forwarding the notification to the PG; means for receiving, from the PG, a revised transfer time for the upcoming transfer; and means for updating the policy with the revised transfer time.

Example 39 includes apparatus for computing of example 38, and/or any other example herein, further comprising means for providing a communication link between the transferring guardian and the PG to allow the PG to verify why the upcoming transfer cannot occur as scheduled and a likely time when the transfer can occur.

Example 40 includes the apparatus for computing of example 35, and/or any other example herein, wherein the policy further defines a virtual fence for the entity to be applied during each pre-defined time period.

Example 41 includes the apparatus for computing of example 38, and/or any other example herein, further comprising means for determining that a suspicious situation has occurred regarding the entity device, and means for alerting the PG that the suspicious situation has occurred.

Example 42 includes the apparatus for computing of any of examples 26-41, and/or any other example herein, wherein the apparatus is implemented in, or in a part of, a cloudlet server.

Example 43 includes the apparatus of any of examples 17-22, and/or any other example herein, wherein the apparatus is implemented in, or in a part of, a cloudlet server.

Example 44 includes the apparatus of example 17, and/or any other example herein, the analyzer further to: receive, via the input interface, location data from the at least one TG, and virtually connect the entity to the at least one TG.

Example 45 includes the apparatus of example 19, and/or any other example herein, wherein the at least one TG is a second TG, and wherein to virtually connect includes to receive, via the input interface, confirmation that an automatic handoff has occurred from either a PG or a first TG to the second TG.

Example 46 includes the apparatus of example 19, and/or any other example herein, wherein to virtually connect the entity to the TG includes to at least one of: enforce an elastic boundary between the entity and the at least one TG; provide, via the output interface, a metadata stream regarding the entity to the at least one TG; or create, via the input interface and the output interface, a monitored communications channel between the entity and the TG.

What is claimed is:

1. One or more non-transitory computer-readable storage media comprising a set of instructions, which, when executed on a processor of a server, causes the server to:

receive sensor data from at least one sensor disposed at a location at a sensing range away from an entity, wherein the entity is a human under care of a temporary guardian (TG) pursuant to a set of guardianship rules, the guardianship rules including a geographic boundary defined relative to a current location of the TG, in which the entity is to remain while under the care of the TG;

extract location metadata of the entity from the sensor data;

determine whether the entity is inside or outside the geographic boundary defined relative to the current location of the TG; and based at least in part on the metadata, send notifications to the TG and to a primary guardian (PG) of the entity when the entity is determined to be outside of the geographic boundary defined relative to the current location of the TG.

2. The one or more non-transitory computer-readable storage media of claim 1, wherein the server is further caused to receive the set of guardianship rules from the PG prior to a commencement of the temporary guardianship.

3. The one or more non-transitory computer-readable storage media of claim 2, wherein the set of guardianship rules is specific to the TG, or to a type of TG.

4. The one or more non-transitory computer-readable storage media of claim 3, wherein the entity is a school-age child, and the type of TG covered by the guardianship rules includes at least one of principal, teacher, teacher's aide, babysitter or bus driver.

5. The one or more non-transitory computer-readable storage media of claim 1, wherein the geographic boundary defined relative to the current location of the TG includes a distance limit from the current location of the TG, and further comprising instructions that, when executed, cause the processor to:

track the current location of the TG; and calculate the distance between the TG and the entity.

6. One or more non-transitory computer-readable storage media comprising a set of instructions, which, when executed on a processor of a server, causes the server to:

receive sensor data from at least one sensor proximate to an entity, wherein the entity is a human under care of at least one temporary guardian (TG) pursuant to a set of guardianship rules, the guardianship rules including a pre-defined geographic boundary in which the entity is to remain while under the care of the at least one TG;

extract location metadata of the entity from the sensor data; and based at least in part on the metadata, send notifications to the TG and to a primary guardian (PG) of the entity when the entity is outside of the pre-defined boundary;

wherein the pre-defined boundary is elastic, and includes a specified distance from one or more TGs, and further comprising instructions that, when executed, cause the processor to track the location of the one or more TGs; and calculate the distance between the one or more TGs and the entity; and wherein the one or more TGs includes a first TG and a second TG, the first TG to primarily supervise the entity, and the second TG is a supervisor of the first TG, and wherein the pre-defined boundary includes a specified first distance from the first TG and a specified second distance from the second TG.

7. The one or more non-transitory computer-readable storage media of claim 6, wherein the second distance is greater than the first distance.

8. The one or more non-transitory computer-readable storage media of claim 6, wherein the first TG is a teacher at a school attended by the entity, and the second TG is a principal of the school.

9. The one or more non-transitory computer-readable storage media of claim 6, wherein the at least one TG includes one or more nurses working in a hospital newborn ward, the entity includes a newborn baby, and the predefined geographic boundary is either a distance from the hospital newborn ward, or walls of the hospital.

10. One or more non-transitory computer-readable storage media comprising a set of instructions, which, when executed on a processor of a cloudlet, cause the cloudlet to:

receive a guardianship policy for an entity from a primary guardian (PG) of the entity, the policy defining one or more transfers of guardianship for the entity between a transferring guardian and a receiving guardian at a pre-defined transfer time, wherein after the transfer the receiving guardian acts as guardian of the entity for a pre-defined time period;

track locations of the entity, the transferring guardian and the receiving guardian; and at the pre-defined transfer time:

pair a client device of the receiving guardian with an entity device, wherein the entity device is worn by or is proximate to the entity; and provide a communication link between the transferring guardian and the receiving guardian.

11. The one or more non-transitory computer-readable storage media of claim 10, wherein the cloudlet is further caused to:

determine that a transfer of guardianship has occurred;

disconnect the entity device from the transferring guardian, if the transferring guardian is a TG.

12. The one or more non-transitory computer-readable storage media of claim 10, further comprising instructions that, when executed, cause the processor to:

determine that the entity has not been transferred to a receiving guardian at the pre-defined transfer time; and send an alert to the PG that a scheduled transfer of guardianship has not occurred.

13. The one or more non-transitory computer-readable storage media of claim 10, further comprising instructions that, when executed, cause the processor to:

receive notification from a transferring guardian that an upcoming transfer cannot occur as scheduled;

forward the notification to the PG;

receive, from the PG, a revised transfer time for the upcoming transfer; and update the policy with the revised transfer time.

14. The one or more non-transitory computer-readable storage media of claim 13, further comprising instructions that, when executed, cause the processor to:

provide a communication link between the transferring guardian and the PG to allow the PG to verify why the upcoming transfer cannot occur as scheduled and a likely time when the transfer can occur.

15. The one or more non-transitory computer-readable storage media of claim 10, wherein the policy further defines a virtual fence for the entity to be applied during each pre-defined time period.

16. The one or more non-transitory computer-readable storage media of claim 13, further comprising instructions that, when executed, cause the processor to:

determine that a suspicious situation has occurred regarding the entity device; and alert the PG that the suspicious situation has occurred.

17. An apparatus, comprising:

an input interface to receive a sensor data stream from a set of sensors proximate to an entity, wherein the entity is under care of at least one temporary guardian (TG) pursuant to a policy, the policy rules including pre-defined restrictions on at least one of:

interactions between the entity and other entities under care of the TG or another TG, or activities the entity may engage in or foods the entity may eat while under the care of the TG;

an output interface;

an analyzer, coupled to the input interface and to the output interface, to:

extract metadata from the sensor data stream, the metadata including behavior detection and activity recognition of the entity; and based at least in part on the metadata, send notifications, via the output interface, to the TG and to a permanent guardian (PG) of the entity when the pre-defined restrictions are violated.

18. The apparatus of claim 17, wherein at least one of:

the set of sensors include one or more of a camera, a global positioning system (GPS) sensor or a BLUETOOTH™ low energy sensor, or the set of sensors is one of wearable by the entity, embedded in the entity, or provided in a computing device carried by the entity or in which the entity is carried or transported.

19. The apparatus of claim 17, the analyzer further to:

receive, via the input interface, location data from the at least one TG, and virtually connect the entity to the at least one TG.

20. The apparatus of claim 19, wherein the at least one TG is a second TG, and wherein to virtually connect includes to receive, via the input interface, confirmation that an automatic handoff has occurred from either a PG or a first TG to the second TG.

21. The apparatus of claim 19, wherein to virtually connect the entity to the TG includes to at least one of:

enforce an elastic boundary between the entity and the at least one TG;

provide, via the output interface, a metadata stream regarding the entity to the at least one TG; or create, via the input interface and the output interface, a monitored communications channel between the entity and the TG.

22. The apparatus of claim 17, wherein the input interface is further to receive the policy, and wherein the pre-defined restrictions include at least one of:

the entity refraining from play with one or more pre-defined other entities also under the care of the TG, preventing the entity from consuming a pre-defined set of foods, or refraining from engaging in a pre-defined set of athletic activities.

23. The apparatus of claim 22, wherein the analyzer is further to send to the TG and to the PG a directive for curative action in response to the violation of the restriction.

24. The apparatus of claim 17, wherein the entity is one of a child of the PG, an elderly relative of the PG or a newborn baby of the PG, and wherein the policy rules include default restrictions for all similar entities that are modifiable in part by the PG or the TG, or both.

25. A method, comprising:

receiving a policy regarding care of an entity;

receiving a directive of delegation of guardianship from a primary guardian (PG) of the entity to a temporary guardian (TG) of the entity, the directive indicating that the TG is to care for the entity during a pre-defined time;

configuring terms of the guardianship by the TG based on the policy;

communicating the terms of the guardianship to the TG;

tracking the entity and the TG during the pre-defined time, in which, at least in part, the entity is mobile; and virtually tying the entity to the TG during the pre-defined time to control a location of the entity.

26. The method of claim 25, wherein virtually tying further comprises creating an elastic boundary within which the entity is to be contained during the guardianship, the elastic boundary defined, at least in part, in terms of proximity to the TG.

27. The method of claim 25, wherein the TG is a first TG, and the pre-defined time is a first pre-defined time, and further comprising:

receiving a directive of delegation of guardianship from the first TG to a second TG, the delegation providing that the second TG is to care for the entity during a second pre-defined time;

configuring terms of the guardianship by the second TG based on the policy;

communicating the terms of the guardianship to the second TG; and tracking the entity and the second TG during the second pre-defined time, in which, at least in part, the entity is mobile; and virtually tying the entity to the second TG during the second pre-defined time to control the location of the entity.

28. The method of claim 27, wherein virtually tying further comprises creating an elastic boundary within which the entity is to be contained during the guardianship, the elastic boundary defined, at least in part, in terms of proximity to the second TG or in terms of proximity to both the first TG and the second TG.

* * * * *